US008190078B2

(12) United States Patent
Tawada

(10) Patent No.: US 8,190,078 B2
(45) Date of Patent: May 29, 2012

(54) TONER CONVEYANCE DEVICE AND IMAGE FORMING APPARATUS INCORPORATING SAME

(75) Inventor: Takaaki Tawada, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 378 days.

(21) Appl. No.: 12/625,874

(22) Filed: Nov. 25, 2009

(65) Prior Publication Data

US 2010/0143011 A1 Jun. 10, 2010

(30) Foreign Application Priority Data

Dec. 5, 2008 (JP) ..... 2008-311388
Mar. 18, 2009 (JP) ..... 2009-065802

(51) Int. Cl.
*G03G 21/00* (2006.01)

(52) U.S. Cl. ..... 399/358; 399/360

(58) Field of Classification Search ..... 399/358, 399/360

See application file for complete search history.

(56) References Cited

U.S. PATENT DOCUMENTS 1,783,092 A * 11/1930 Lewis ..... 222/231
7,373,092 B2 5/2008 Tawada
2003/0234262 A1* 12/2003 Hart ..... 222/233
2008/0013998 A1 1/2008 Kumagai et al.
2008/0031666 A1 2/2008 Tawada

FOREIGN PATENT DOCUMENTS

JP 2006-259426 9/2006
JP 2007-34340 2/2007
JP 3912072 2/2007
JP 2008129152 A * 6/2008

* cited by examiner

*Primary Examiner* — David Gray
*Assistant Examiner* — G. M. Hyder
(74) *Attorney, Agent, or Firm* — Oblon, Spivak, McClelland, Maier & Neustadt, L.L.P.

(57) ABSTRACT

In a toner conveyance device, a first agitator contacts a helical outer circumferential surface of a blade of a conveyance member for conveying toner, and swings in coordination with rotation of the conveyance member to agitate the toner. The first agitator includes a body for bending and swinging in a bending direction perpendicular to an axial direction of the conveyance member, and a protrusion for protruding from the body in a protrusion direction opposite the bending direction of the body. The protrusion includes a basal portion adjacent to the body, a convex portion protruding from the basal portion, and a protrusion front edge surface having a distance from the body changing in a toner conveyance direction, and contacts the helical outer circumferential surface of the helical blade of the conveyance member.

17 Claims, 11 Drawing Sheets

TONER CONVEYANCE DEVICE AND IMAGE FORMING APPARATUS INCORPORATING SAME

CROSS-REFERENCE TO RELATED APPLICATION

The present application is based on and claims priority to Japanese Patent Application Nos. 2008-311388, filed on Dec. 5, 2008, and 2009-065802, filed on Mar. 18, 2009, in the Japan Patent Office, each of which is hereby incorporated herein by reference in its entirety.

BACKGROUND OF THE INVENTION

1. Field of the Invention

Exemplary aspects of the present invention relate to a toner conveyance device and an image forming apparatus, and more particularly, to a toner conveyance device for conveying toner and an image forming apparatus including the toner conveyance device.

2. Description of the Related Art

Related-art image forming apparatuses, such as copiers, facsimile machines, printers, or multifunction printers having at least one of copying, printing, scanning, and facsimile functions, typically form an image on a recording medium (e.g., a transfer sheet) according to image data. Thus, for example, a charger uniformly charges a surface of an image carrier; an optical writer emits a light beam onto the charged surface of the image carrier to form a latent image on the image carrier according to the image data; a development device supplies toner to the latent image formed on the image carrier to make the latent image visible as a toner image; the toner image is directly transferred from the image carrier onto a recording medium or is indirectly transferred from the image carrier onto a recording medium via an intermediate transfer member; a cleaner then collects residual toner not transferred and remaining on the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The cleaner may include a toner conveyance device in which a conveyance screw including a helical blade rotates and conveys the toner collected by the cleaner from the surface of the image carrier in an axial direction of the conveyance screw. However, in such toner conveyance device, the toner may build up inside a toner conveyance path and clog the toner conveyance path. To address this, the toner conveyance device may include an agitator for swingingly contacting the conveyance screw in coordination with rotation of the conveyance screw so as to agitate the toner contained in the toner conveyance device and prevent clogging of the toner conveyance device.

FIGS. 1, 2A, and 2B illustrate a toner conveyance device 130V including an agitator 16V as an example of such agitator. FIG. 1 is a perspective view of the toner conveyance device 130V. FIGS. 2A and 2B illustrate a sectional view of the toner conveyance device 130V seen from a direction S in FIG. 1. The toner conveyance device 130V includes a conveyance screw 131V including a helical blade 131Vb fixedly mounted on a shaft 131Va. When the conveyance screw 131V rotates in a rotation direction R, the conveyance screw 131V conveys toner in a toner conveyance direction C. The agitator 16V includes a cantilevered plate member formed of a flexible material, with a fixed end and a free end. The free end of the cantilevered plate member includes a plurality of comb teeth 160V. The comb teeth 160V bend in coordination with rotation of the conveyance screw 131V, that is, the comb teeth 160V move reciprocally between a bent position at which the comb teeth 160V are contacted and pushed up by a helical outer circumferential surface 131Vt of the blade 131Vb of the conveyance screw 131V as illustrated in FIG. 2A, and a straight position at which the comb teeth 160V enter a helical gap of the blade 131Vb as illustrated in FIG. 2B. The comb teeth 160V swing in a direction M as the conveyance screw 131V rotates, and thus, a distance D between the tips of the comb teeth 160V and the surface of the shaft 131Va of the conveyance screw 131V fluctuates within a predetermined range.

When the comb tooth 160V is contacted and bent by the blade 131Vb as illustrated in FIG. 2A, a lower surface 160Va, not a front edge surface 160Vt, of the comb tooth 160V contacts the blade 131Vb. As noted above, as the conveyance screw 131V rotates, the comb tooth 160V enters the helical gap of the blade 131Vb as illustrated in FIG. 2B. As the conveyance screw 131V rotates further, the comb tooth 160V is contacted and bent by the blade 131Vb again as illustrated in FIG. 2A.

However, before the blade 131Vb contacts the lower surface 160Va of the comb tooth 160V, the blade 131Vb contacts an upstream edge surface 160Vs of the comb tooth 160V. Accordingly, the free end of the comb tooth 160V is bent downstream in the toner conveyance direction C and twisted. As the conveyance screw 131V continues to rotate and the comb tooth 160V resumes its original untwisted shape, and the blade 131Vb contacts the lower surface 160Va of the comb tooth 160V, the blade 131Vb hits the comb tooth 160V, generating noise.

BRIEF SUMMARY OF THE INVENTION

This specification describes below a toner conveyance device according to an exemplary embodiment of the present invention. In one exemplary embodiment of the present invention, the toner conveyance device includes a conveyance path formation member, a conveyance member, and a first agitator. The conveyance path formation member defines a conveyance path through which to convey toner. The conveyance member is disposed within the conveyance path defined by the conveyance path formation member, and rotates and conveys the toner through the conveyance path in a toner conveyance direction corresponding to an axial direction of the conveyance member. The conveyance member includes a helical blade having a helical outer circumferential surface. The first agitator includes a cantilevered, comb-toothed plate member of flexible material having a fixed end and a free end. The free end contacts the helical outer circumferential surface of the helical blade of the conveyance member and swings in coordination with rotation of the conveyance member to agitate the toner as the toner is conveyed through the conveyance path.

The first agitator further includes a body and a protrusion. The body bends in a bending direction substantially perpendicular to the axial direction of the conveyance member. The protrusion protrudes from the body in a protrusion direction opposite the bending direction of the body.

The protrusion includes a basal portion, a convex portion, and a protrusion front edge surface. The basal portion is continuous with and adjacent and connected to the body. The basal portion has a first width greater than a helical pitch of the helical blade of the conveyance member in the axial direction of the conveyance member. The convex portion protrudes from the basal portion and has a second width smaller than the helical pitch of the helical blade of the conveyance member in the axial direction of the conveyance member. The protrusion front edge surface is provided on a front edge of the protrusion to contact the helical outer circumferential surface of the helical blade of the conveyance member. A distance between the protrusion front edge surface of the protrusion and the body changes within a predetermined range in the toner conveyance direction along the protrusion front edge surface of the protrusion.

This specification describes below an image forming apparatus according to an exemplary embodiment of the present invention. In one exemplary embodiment of the present invention, the image forming apparatus includes an image carrier, a toner supplier, a development member, a transferor, a cleaning member, a waste toner container, a first toner conveyer, a second toner conveyer, a third toner conveyer, a fourth toner conveyer, and a toner conveyance device.

The image carrier carries a latent image. The toner supplier contains toner. The development member supplies the toner supplied from the toner supplier to the latent image carried by the image carrier to form a toner image. The transferor transfers the toner image from the image carrier onto an intermediate transfer member or a recording medium. The cleaning member collects residual toner remaining on the image carrier after the toner image is transferred. The waste toner container receives and contains the toner sent from the cleaning member. The first toner conveyer conveys the toner supplied from the toner supplier to the development member. The second toner conveyer conveys the toner collected by the cleaning member inside a housing containing the cleaning member. The third toner conveyer conveys the toner sent from the cleaning member to the development member. The fourth toner conveyer conveys the toner sent from the cleaning member to the waste toner container. The toner conveyance device is provided in at least one of the first toner conveyer, the second toner conveyer, the third toner conveyer, and the fourth toner conveyer.

The toner conveyance device includes a conveyance path formation member, a conveyance member, and a first agitator. The conveyance path formation member defines a conveyance path through which to convey toner. The conveyance member is disposed within the conveyance path defined by the conveyance path formation member, and rotates and conveys the toner through the conveyance path in a toner conveyance direction corresponding to an axial direction of the conveyance member. The conveyance member includes a helical blade having a helical outer circumferential surface. The first agitator includes a cantilevered, comb-toothed plate member of flexible material having a fixed end and a free end. The free end contacts the helical outer circumferential surface of the helical blade of the conveyance member and swings in coordination with rotation of the conveyance member to agitate the toner as the toner is conveyed through the conveyance path.

The first agitator further includes a body and a protrusion. The body bends in a bending direction substantially perpendicular to the axial direction of the conveyance member. The protrusion protrudes from the body in a protrusion direction opposite the bending direction of the body.

The protrusion includes a basal portion, a convex portion, and a protrusion front edge surface. The basal portion is continuous with and adjacent and connected to the body. The basal portion has a first width greater than a helical pitch of the helical blade of the conveyance member in the axial direction of the conveyance member. The convex portion protrudes from the basal portion and has a second width smaller than the helical pitch of the helical blade of the conveyance member in the axial direction of the conveyance member. The protrusion front edge surface is provided on a front edge of the protrusion to contact the helical outer circumferential surface of the helical blade of the conveyance member. A distance between the protrusion front edge surface of the protrusion and the body changes within a predetermined range in the toner conveyance direction along the protrusion front edge surface of the protrusion.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
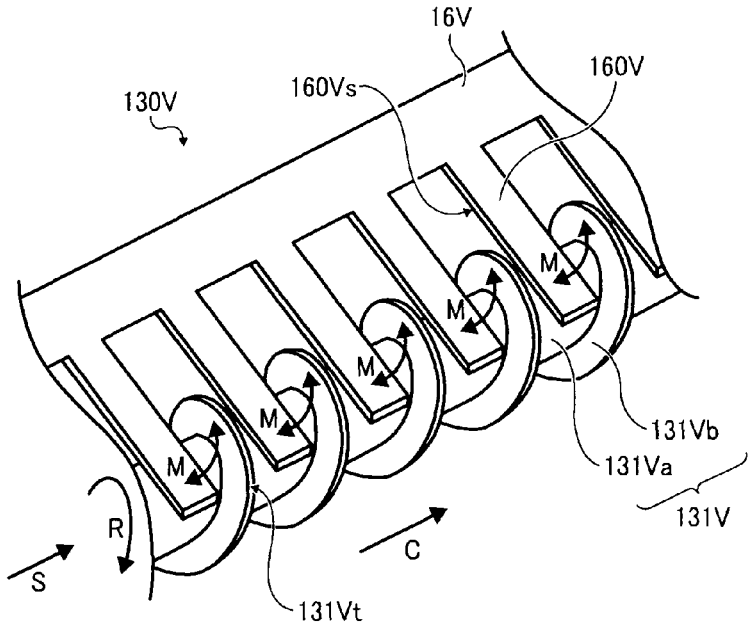
FIG. 1 RELATED ART
FIG. 1 is a perspective view of a related art toner conveyance device.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Figure 3:
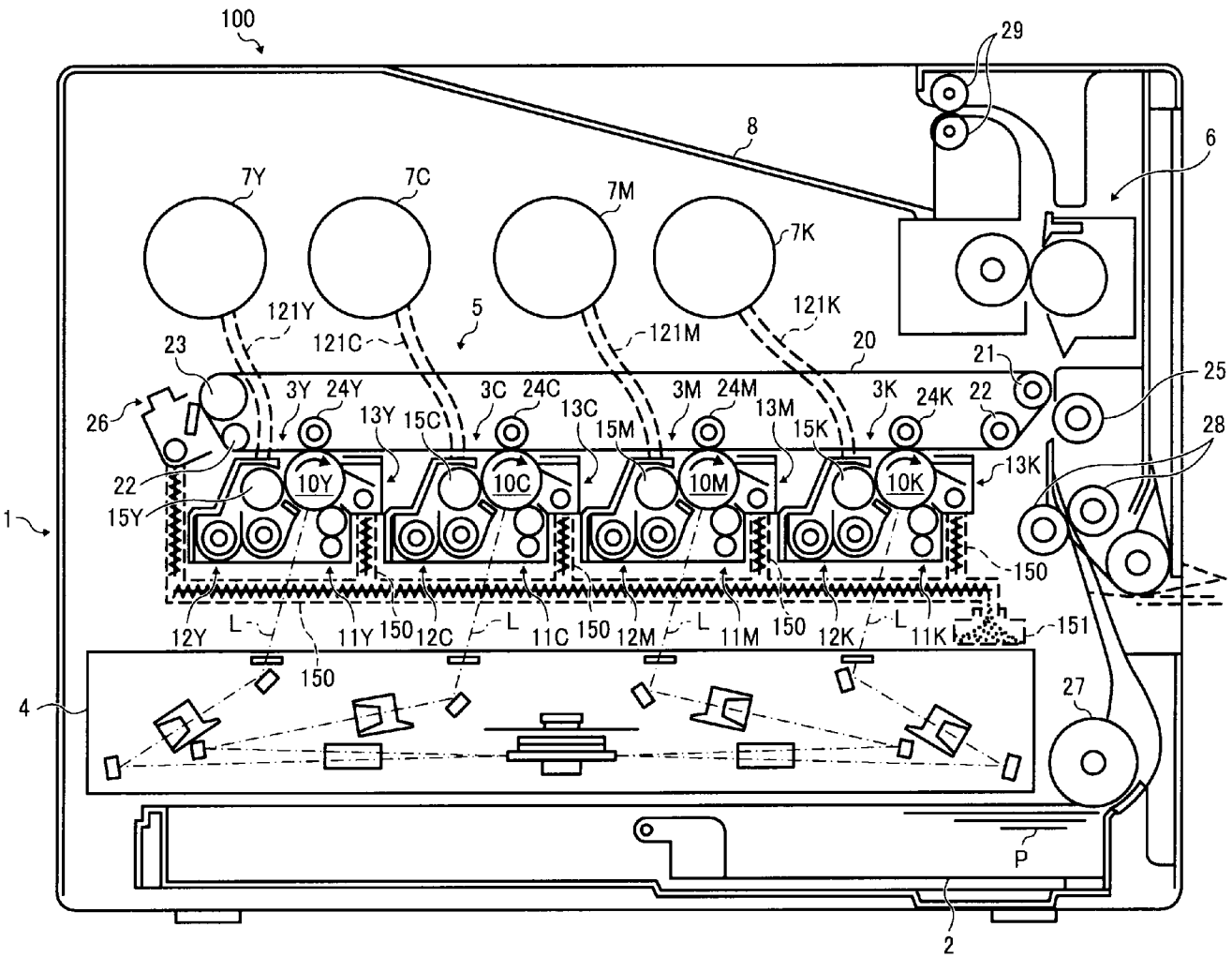
FIG. 3 is a schematic view of an image forming apparatus according to an exemplary embodiment of the present invention.

Referring now to the drawings, wherein like reference numerals designate identical or corresponding parts throughout the several views, in particular to FIG. 3, an image forming apparatus 100 according to an exemplary embodiment of the present invention is explained.

FIG. 3 is a schematic view of the image forming apparatus 100. As illustrated in FIG. 3, the image forming apparatus 100 includes a body 1, a paper tray 2, an output tray 8, and a feed roller 27.

The body 1 includes image forming stations 3Y, 3C, 3M, and 3K, an optical unit 4, an intermediate transfer unit 5, a fixing device 6, toner bottles 7Y, 7C, 7M, and 7K, a registration roller pair 28, an output roller pair 29, first toner conveyers 121Y, 121C, 121M, and 121K, a fourth toner conveyer 150, and a waste toner container 151.

The image forming stations 3Y, 3C, 3M, and 3K include photoconductors 10Y, 10C, 10M, and 10K, chargers 11Y, 11C, 11M, and 11K, development devices 12Y, 12C, 12M, and 12K, and cleaners 13Y, 13C, 13M, and 13K, respectively. The development devices 12Y, 12C, 12M, and 12K include development rollers 15Y, 15C, 15M, and 15K, respectively.

The intermediate transfer unit 5 includes a transfer belt 20, a driving roller 21, tension rollers 22, a driven roller 23, first transfer rollers 24Y, 24C, 24M, and 24K, a second transfer roller 25, and a belt cleaner 26.

Figure 4A:
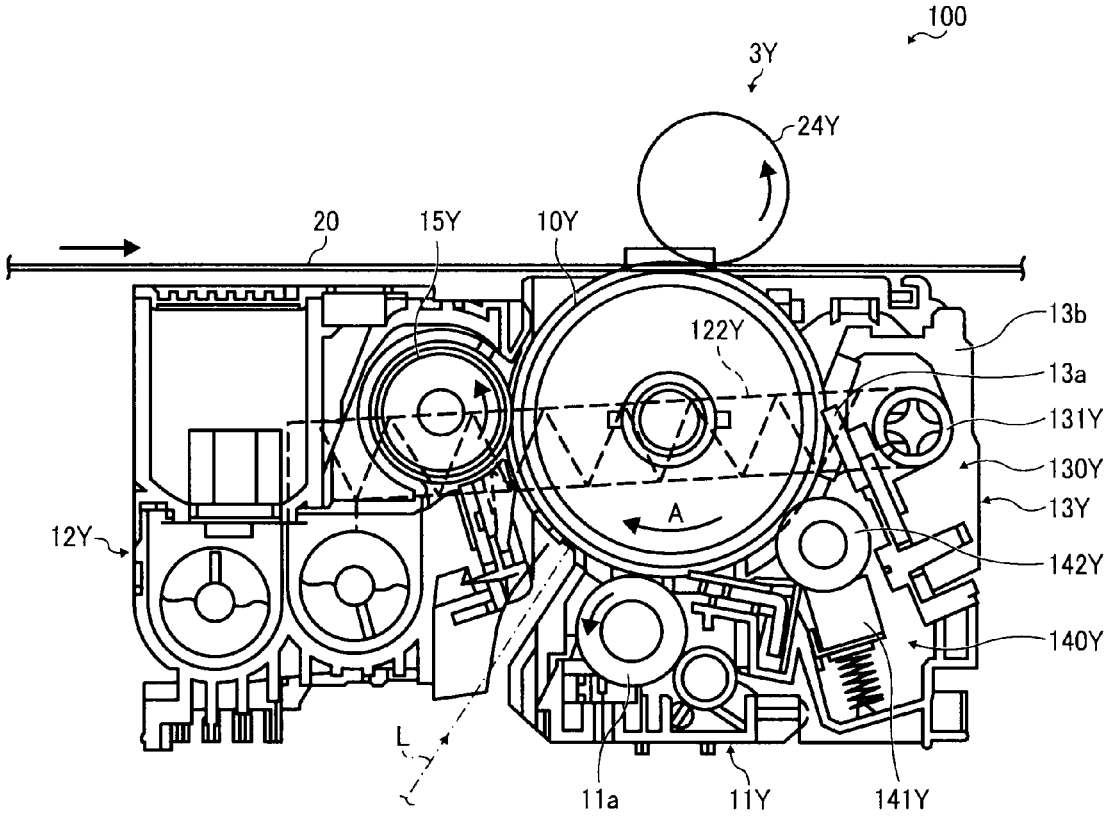
FIG. 4A is a schematic view of an image forming station included in the image forming apparatus shown in FIG. 3.
Figure 4B:
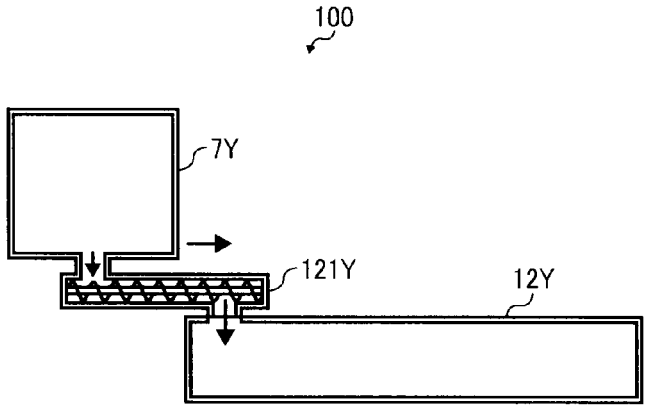
FIG. 4B is a sectional view of a toner bottle, a development device, and a first toner conveyer included in the image forming apparatus shown in FIG. 3.

FIG. 4A is a schematic view of the image forming station 3Y. FIG. 4B is a sectional view of the toner bottle 7Y, the development device 12Y, and the first toner conveyer 121Y. As illustrated in FIG. 4A, the image forming station 3Y further includes a third toner conveyer 122Y and a lubricant applier 140Y. The lubricant applier 140Y includes a solid lubricant 141Y and a brush roller 142Y. The charger 11Y includes a charging roller 11*a*. The cleaner 13Y includes a cleaning blade 13*a* and a toner conveyance device 130Y. The toner conveyance device 130Y includes a casing 13*b* and a conveyance screw 131Y.

Each of the image forming stations 3C, 3M, and 3K depicted in FIG. 3 has a structure equivalent to a structure of the image forming station 3Y depicted in FIG. 4A.

As illustrated in FIG. 3, the image forming apparatus 100 can be a copier, a facsimile machine, a printer, a multifunction printer having at least one of copying, printing, scanning, plotter, and facsimile functions, or the like. According to this exemplary embodiment of the present invention, the image forming apparatus 100 functions as a full-color printer for forming a color image on a recording medium.

The body 1 is fixed in the image forming apparatus 100, and contains elements serving as image forming members. The paper tray 2 is detachably attached to the image forming apparatus 100, and contains transfer sheets P serving as recording media. The image forming stations 3Y, 3C, 3M, and 3K are provided in a center portion of the image forming apparatus 100, and form yellow, cyan, magenta, and black toner images.

As illustrated in FIG. 4A, in the image forming station 3Y, the photoconductor 10Y, serving as an image carrier and having a drum shape, receives a driving force transmitted from a driver and rotates in a rotation direction A. The photoconductor 10Y includes a cylindrical base and a photoconductive layer covering a surface of the cylindrical base. For example, the cylindrical base includes aluminum. The photoconductive layer includes OPC (organic photoconductor).

As illustrated in FIG. 3, the chargers 11Y, 110, 11M, and 11K, the development devices 12Y, 12C, 12M, and 12K, and the cleaners 13Y, 13C, 13M, and 13K surround the photoconductors 10Y, 10C, 10M, and 10K, respectively. The chargers 11Y, 11C, 11M, and 11K charge surfaces of the photoconductors 10Y, 10C, 10M, and 10K, respectively. The development devices 12Y, 12C, 12M, and 12K make latent images formed by the optical unit 4 on the charged surfaces of the photoconductors 10Y, 10C, 10M, and 10K visible as yellow, cyan, magenta, and black toner images by using yellow, cyan, magenta, and black toners contained in the development devices 12Y, 12C, 12M, and 12K, respectively. The first toner conveyers 121Y, 121C, 121M, and 121K connect the toner bottles 7Y, 7C, 7M, and 7K to the development devices 12Y, 12C, 12M, and 12K to convey fresh yellow, cyan, magenta, and black toners from the toner bottles 7Y, 7C, 7M, and 7K to the development devices 12Y, 12C, 12M, and 12K, respectively. The cleaners 13Y, 13C, 13M, and 13K remove residual toners remaining on the surfaces of the photoconductors 10Y, 10C, 10M, and 10K after the yellow, cyan, magenta, and black toner images are transferred onto the intermediate transfer unit 5. The fourth toner conveyer 150 connects the cleaners 13Y, 13C, 13M, and 13K to the waste toner container 151 to convey the toners removed by the cleaners 13Y, 13C, 13M, and 13K to the waste toner container 151.

The optical unit 4 is provided below the image forming stations 3Y, 3C, 3M, and 3K, and serves as an exposure device for emitting laser beams L onto the charged surfaces of the photoconductors 10Y, 10C, 10M, and 10K, respectively. The intermediate transfer unit 5 is provided above the image forming stations 3Y, 3C, 3M, and 3K, and includes the transfer belt 20 serving as an intermediate transfer member which receives the yellow, cyan, magenta, and black toner images transferred from the photoconductors 10Y, 10C, 10M, and 10K of the image forming stations 3Y, 3C, 3M, and 3K, respectively. Specifically, the yellow, cyan, magenta, and black toner images are superimposed on the transfer belt 20 to form a color toner image on the transfer belt 20. The fixing device 6 fixes the color toner image transferred from the transfer belt 20 onto a transfer sheet P. The toner bottles 7Y, 7C, 7M, and 7K, serving as a toner supplier, are provided in an upper portion of the body 1, and contain fresh yellow, cyan, magenta, and black toners to be sent to the development devices 12Y, 12C, 12M, and 12K via the first toner conveyers 121Y, 121C, 121M, and 121K, respectively. When a user opens the output tray 8 provided on top of the body 1, the user can attach and detach the toner bottles 7Y, 7C, 7M, and 7K to and from the image forming apparatus 100.

In the optical unit 4, a polygon mirror reflects laser beams L emitted by a laser diode serving as a light source onto the charged surfaces of the photoconductors 10Y, 10C, 10M, and 10K, so that the laser beams L scan the charged surfaces of the photoconductors 10Y, 10C, 10M, and 10K, respectively.

In the intermediate transfer unit 5, the transfer belt 20 is looped over the driving roller 21, the tension rollers 22, and the driven roller 23. The transfer belt 20 is driven and rotated counterclockwise in FIG. 3 at a predetermined time. The first transfer rollers 24Y, 24C, 24M, and 24K transfer the yellow, cyan, magenta, and black toner images formed on the photoconductors 10Y, 100, 10M, and 10K, respectively, onto the transfer belt 20 to form the color toner image on the transfer belt 20. The second transfer roller 25 transfers the color toner image formed on the transfer belt 20 onto a transfer sheet P. The belt cleaner 26 removes residual toner not transferred onto the transfer sheet P and therefore remaining on the transfer belt 20 from the transfer belt 20. The fourth toner conveyer 150 connects the belt cleaner 26 to the waste toner container 151 to convey the toner removed by the belt cleaner 26 to the waste toner container 151.

Referring to FIGS. 3 and 4A, the following describes processes for forming a color image in the image forming apparatus 100. In the image forming stations 3Y, 3C, 3M, and 3K, the charging rollers 11*a* of the chargers 11Y, 11C, 11M, and 11K uniformly charge the surfaces of the photoconductors 10Y, 10C, 10M, and 10K driven and rotated by a driver, respectively. The optical unit 4 emits laser beams L onto the charged surfaces of the photoconductors 10Y, 10C, 10M, and 10K according to image data to form latent images on the surfaces of the photoconductors 10Y, 10C, 10M, and 10K, respectively. In other words, the laser beams L scan and expose the charged surfaces of the photoconductors 10Y, 10C, 10M, and 10K, respectively. Yellow, cyan, magenta, and black toners carried by the development rollers 15Y, 15C, 15M, and 15K of the development devices 12Y, 12C, 12M, and 12K develop the latent images on the photoconductors 10Y, 10C, 10M, and 10K to make the latent images visible as yellow, cyan, magenta, and black toner images, respectively.

The first transfer rollers 24Y, 24C, 24M, and 24K transfer the yellow, cyan, magenta, and black toner images formed on the photoconductors 10Y, 10C, 10M, and 10K, respectively, onto the transfer belt 20 driven and rotated counterclockwise in FIG. 3 successively, so that the yellow, cyan, magenta, and black toner images are superimposed on the transfer belt 20 to form a color toner image on the transfer belt 20. Specifically, the yellow, cyan, magenta, and black toner images are transferred onto the transfer belt 20 at different times, respectively, from upstream to downstream in a moving direction of the transfer belt 20, that is, from the photoconductors 10Y, 10C, 10M, and 10K in this order, so that the yellow, cyan, magenta, and black toner images are superimposed on a same position on the transfer belt 20.

The cleaning blades 13*a* of the cleaners 13Y, 13C, 13M, and 13K clean the surfaces of the photoconductors 10Y, 10C, 10M, and 10K after the yellow, cyan, magenta, and black toner images are transferred from the photoconductors 10Y, 10C, 10M, and 10K onto the transfer belt 20, respectively. Thus, the photoconductors 10Y, 10C, 10M, and 10K become ready for next image formation.

The fresh yellow, cyan, magenta, and black toners contained in the toner bottles 7Y, 7C, 7M, and 7K are supplied to the development devices 12Y, 12C, 12M, and 12K of the image forming stations 3Y, 3C, 3M, and 3K through conveyance paths (e.g., the first toner conveyers 121Y, 121C, 121M, and 121K), respectively, in a predetermined amount as needed.

The feed roller 27 provided near the paper tray 2 feeds a transfer sheet P set in the paper tray 2 into the body 1. In the body 1, the registration roller pair 28 feeds the transfer sheet P toward the second transfer roller 25 at a predetermined time. The second transfer roller 25 transfers the color toner image formed on the transfer belt 20 onto the transfer sheet P, and feeds the transfer sheet P bearing the color toner image toward the fixing device 6. The fixing device 6 fixes the color toner image on the transfer sheet P while the transfer sheet P bearing the toner image passes through the fixing device 6, and feeds the transfer sheet P bearing the fixed color toner image toward the output roller pair 29. The output roller pair 29 outputs the transfer sheet P bearing the fixed color toner image onto the output tray 8.

Like the cleaners 13Y, 13C, 13M, and 13K for cleaning the photoconductors 10Y, 10C, 10M, and 10K, respectively, the belt cleaner 26 contacting the transfer belt 20 cleans the transfer belt 20 by removing residual toner remaining on the transfer belt 20 from the transfer belt 20.

According to this exemplary embodiment, the image forming stations 3Y, 3C, 3M, and 3K and the toner bottles 7Y, 7C, 7M, and 7K are arranged in this order in the moving direction of the transfer belt 20, from left to right in FIG. 3. Alternatively, the image forming stations 3Y, 3C, 3M, and 3K and the toner bottles 7Y, 7C, 7M, and 7K may be arranged in other order.

As illustrated in FIG. 4A, in the cleaner 13Y, the toner conveyance device 130Y conveys toner collected from the surface of the photoconductor 10Y by the cleaning blade 13*a*.

The lubricant applier 140Y is provided downstream from a contact position at which the cleaning blade 13*a* contacts the photoconductor 10Y in the rotation direction A of the photoconductor 10Y. The lubricant applier 140Y applies a lubricant to the surface of the photoconductor 10Y. Specifically, the brush roller 142Y, which rotates while contacting the photoconductor 10Y and the solid lubricant 141Y, scrapes the solid lubricant 141Y and applies a scraped lubricant to the photoconductor 10Y.

The image forming station 3Y may be a process cartridge (e.g., a detachable unit) detachably attached to the image forming apparatus 100 depicted in FIG. 3. In the process cartridge, the photoconductor 10Y, the charger 11Y, the development device 12Y, the cleaner 13Y, and the lubricant applier 140Y are integrally supported. Each of the other three image forming stations 3C, 3M, and 3K has a structure equivalent to the above-described structure of the image forming station 3Y, and serves as a process cartridge detachably attached to the image forming apparatus 100.

FIG. 3 illustrates one example of the structure of the image forming apparatus 100 including the toner conveyance device 130Y. Alternatively, the image forming apparatus 100 may have other structure. For example, according to this exemplary embodiment, the yellow, cyan, magenta, and black toner images formed on the photoconductors 10Y, 10C, 10M, and 10K, respectively, are transferred onto the transfer belt 20, and then transferred onto the transfer sheet P. Alternatively, the yellow, cyan, magenta, and black toner images formed on the photoconductors 10Y, 10C, 10M, and 10K, respectively, may be transferred onto the transfer sheet P directly.

As illustrated in FIGS. 3 and 4B, the first toner conveyers 121Y, 121C, 121M, and 121K convey fresh yellow, cyan, magenta, and black toners supplied from the toner bottles 7Y, 7C, 7M, and 7K to the development rollers 15Y, 15C, 15M, and 15K, serving as a development member, of the development devices 12Y, 12C, 12M, and 12K, respectively. As illustrated in FIG. 4A, the toner conveyance device 130Y serving as a second toner conveyer conveys toner collected by the cleaning blade 13*a* serving as a cleaning member inside the casing 13*b* in which the cleaning blade 13*a* is provided. The third toner conveyer 122Y conveys the toner collected and sent by the cleaning blade 13*a* to the development roller 15Y. As illustrated in FIG. 3, the fourth toner conveyer 150 conveys the toner collected by the cleaning blade 13*a* of each of the cleaners 13Y, 13C, 13M, and 13K to the waste toner container 151.

Figure 5A:
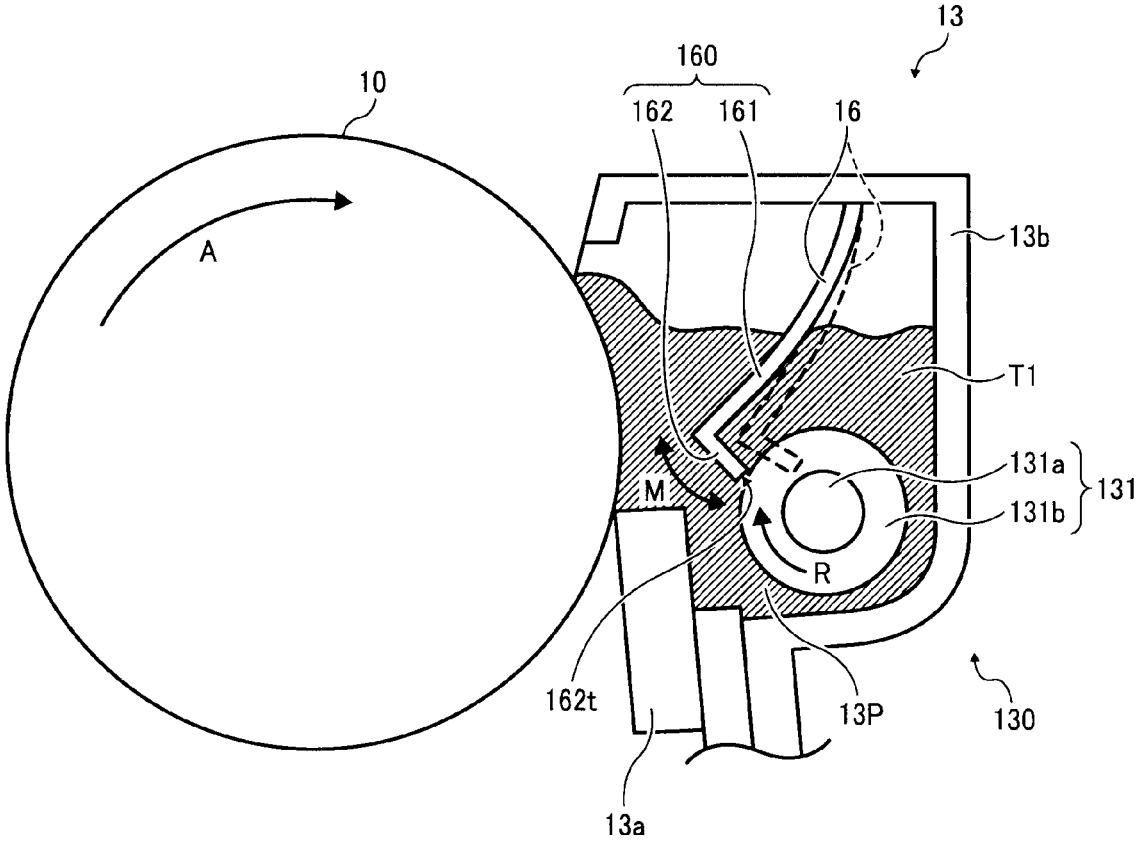
FIG. 5A is a sectional view of a cleaner and a photoconductor included in the image forming station shown in FIG. 4A.
Figure 5B:
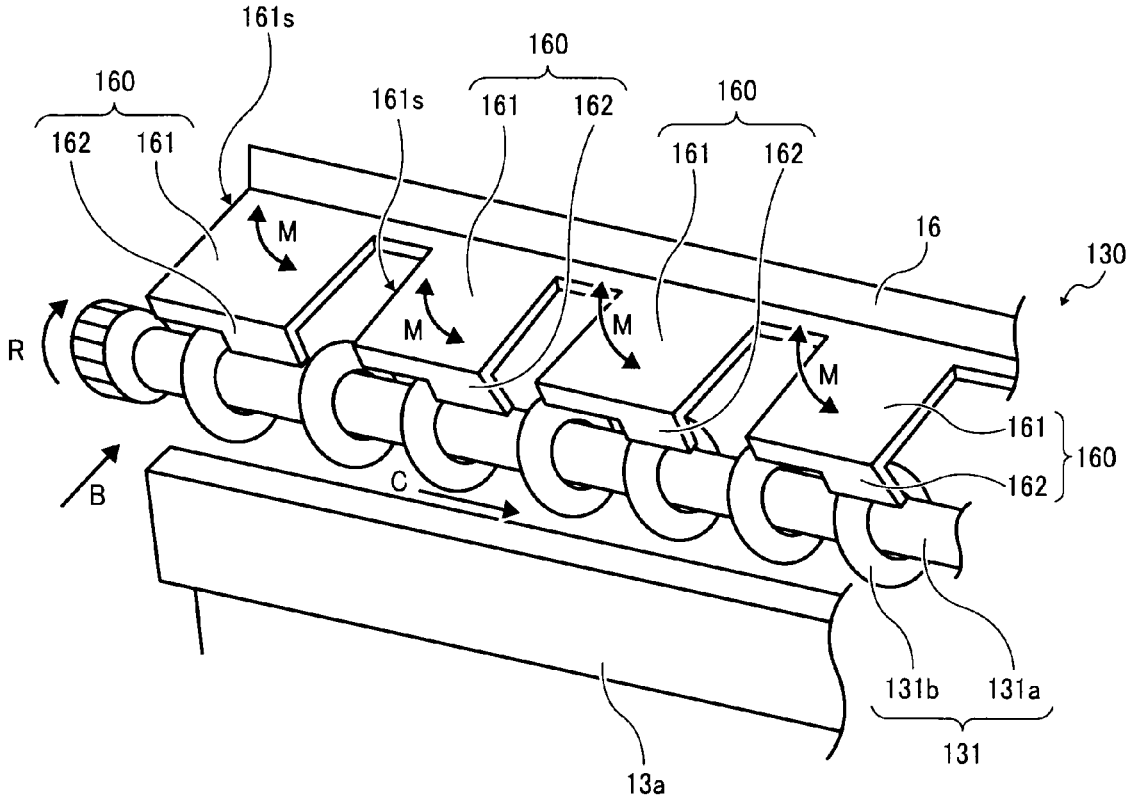
FIG. 5B is a perspective view of a toner conveyance device included in the cleaner shown in FIG. 5A.

Referring to FIGS. 5A and 5B, the following describes a toner conveyance device 130. FIG. 5A is a sectional view of a cleaner 13 and a photoconductor 10. FIG. 5B is a perspective view of the toner conveyance device 130 included in the cleaner 13. The photoconductor 10 and the cleaner 13 are equivalent to the photoconductors 10Y, 10C, 10M, and 10K, and the cleaners 13Y, 13C, 13M, and 13K depicted in FIG. 3, respectively. The toner conveyance device 130 is equivalent to the toner conveyance device 130Y depicted in FIG. 4A.

As illustrated in FIG. 5A, the cleaner 13 includes the cleaning blade 13*a*, the casing 13*b*, and the toner conveyance device 130. The toner conveyance device 130 includes a conveyance path 13P, an agitator 16, and a conveyance screw 131. The agitator 16 includes comb teeth 160. Each of the comb teeth 160 includes a body 161 and a protrusion 162. The protrusion 162 includes a protrusion front edge surface 162*t*. The conveyance screw 131 includes a shaft 131*a* and a blade 131*b*.

As illustrated in FIG. 5B, the body 161 includes a body upstream edge surface 161*s*.

As illustrated in FIG. 5A, in the cleaner 13, the cleaning blade 13*a* contacts the photoconductor 10 in a counter direction counter to the rotation direction A of the photoconductor 10 so as to collect a foreign substance (e.g., collection toner T1) from a surface of the photoconductor 10. The casing 13*b* contains the collection toner T1 collected by the cleaning blade 13*a*. The toner conveyance device 130 conveys the collection toner T1 inside the casing 13*b* in a direction parallel to an axial direction of the photoconductor 10. According to this exemplary embodiment, the casing 13*b* of the cleaner 13 serves as a conveyance path formation member for forming the conveyance path 13P of the toner conveyance device 130.

The conveyance screw 131, serving as a conveyance member, has a screw shape in which the helical blade 131*b* is fixedly mounted on the shaft 131*a*. The conveyance screw 131 rotates and conveys the collection toner T1 inside the casing 13*b*. The conveyance screw 131 receives a driving force transmitted from a driver of the photoconductor 10 via a transmission gear. When the conveyance screw 131 rotates in a rotation direction R, the conveyance screw 131 conveys the collection toner T1 inside the casing 13*b* in an axial direction of the conveyance screw 131, that is, in a toner conveyance direction C depicted in FIG. 5B. According to this exemplary embodiment, the conveyance screw 131 is driven by the driver for driving and rotating the photoconductor 10 and other rotating members. Alternatively, the conveyance screw 131 may be driven by a driver for driving and rotating the conveyance screw 131 only.

The agitator 16 contacts the conveyance screw 131, and swings in a direction M in coordination with rotation of the conveyance screw 131. The agitator 16 includes a plate member formed of a flexible material and has a cantilever structure. As illustrated in FIG. 5B, a plurality of comb teeth 160 is provided on a free end of the cantilever structure of the agitator 16 in such a manner that the agitator 16 has a comb shape. When the free end of the agitator 16 swings, the agitator 16 agitates the collection toner T1 in the casing 13*b* depicted in FIG. 5A. According to this exemplary embodiment, the agitator 16 includes PET (polyethylene terephthalate) mylar. Alternatively, the agitator 16 may include other flexible material.

As illustrated in FIG. 5A, a front end (e.g., a free end) of the comb tooth 160 of the agitator 16 is bent at a substantially right angle. The body 161 (e.g., a fixed end) of the comb tooth 160 serves as a cantilevered plate member. As the body 161 swings, the body 161 is bent in various amounts with respect to a bent edge of the comb tooth 160. The protrusion 162 serves as the free end of the comb tooth 160 and protrudes from the body 161 in a direction opposite to a bending direction in which the body 161 is bent. The protrusion front edge surface 162*t* of the protrusion 162 is provided on a front edge of the protrusion 162 in a protrusion direction in which the protrusion 162 protrudes, and contacts the blade 131*b* of the conveyance screw 131.

Figure 6A:
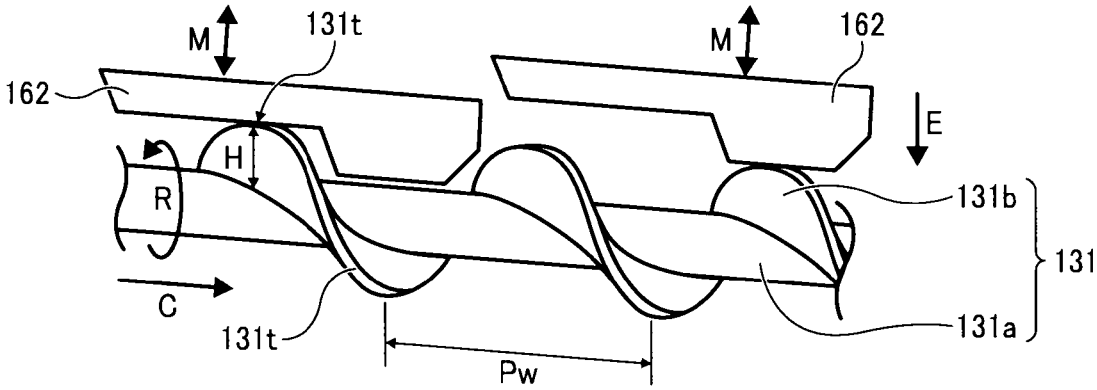
FIG. 6A is an enlarged view of adjacent two protrusions and a conveyance screw included in the toner conveyance device shown in FIG. 5B seen in a direction B in FIG. 5B.
Figure 6B:
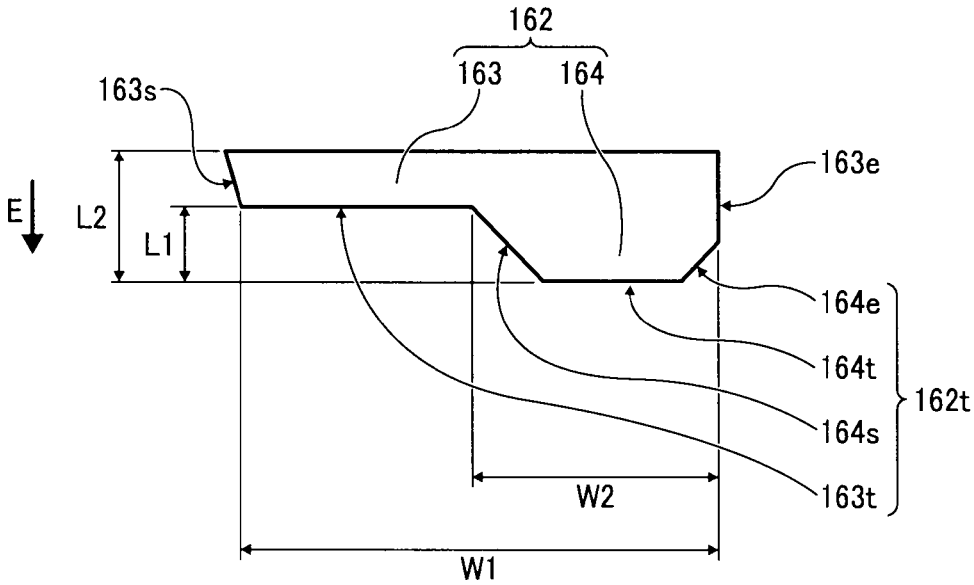
FIG. 6B is an enlarged view of one of the two protrusions shown in FIG. 6A.

Referring to FIGS. 6A and 6B, the following describes the protrusion 162. FIG. 6A is an enlarged view of the adjacent two protrusions 162 and the conveyance screw 131 seen in a direction B in FIG. 5B. FIG. 6B is an enlarged view of one protrusion 162.

As illustrated in FIG. 6A, the blade 131*b* includes a helical outer circumferential surface 131*t*.

As illustrated in FIG. 6B, the protrusion 162 further includes a basal portion 163 and a convex portion 164. The basal portion 163 includes a basal upstream edge surface 163*s*, a basal front edge surface 163*t*, and a basal downstream edge surface 163*e*. The convex portion 164 includes a convex upstream edge surface 164*s*, a convex front edge surface 164*t*, and a convex downstream edge surface 164*e*.

As illustrated in FIG. 6B, the protrusion 162 includes the basal portion 163 and the convex portion 164. The basal portion 163 is adjacent and connected to the body 161 depicted in FIG. 5B. The convex portion 164 serves as a front portion of the protrusion 162 provided on a side of the basal portion 163 opposite to a side of the basal portion 163 connected to the body 161 in a protrusion direction E in which the protrusion 162 protrudes. A width W1 of the basal portion 163 in the axial direction of the conveyance screw 131 depicted in FIG. 6A is greater than a helical pitch Pw of the blade 131*b* depicted in FIG. 6A. A width W2 of the convex portion 164 in the axial direction of the conveyance screw 131 is smaller than the helical pitch Pw of the blade 131*b*.

As edge surfaces corresponding to a thickness of the cantilevered plate member forming the agitator 16 depicted in FIG. 5A, the protrusion 162 includes the basal upstream edge surface 163*s*, the basal front edge surface 163*t*, the convex upstream edge surface 164*s*, the convex front edge surface 164*t*, the convex downstream edge surface 164*e*, and the basal downstream edge surface 163*e*.

In FIG. 6A illustrating the two protrusions 162, the basal front edge surface 163*t* (depicted in FIG. 6B) of the left protrusion 162 contacts the helical outer circumferential surface 131*t* of the blade 131*b*. The convex front edge surface 164*t* (depicted in FIG. 6B) of the right protrusion 162 contacts the helical outer circumferential surface 131*t* of the blade 131*b*. When the helical outer circumferential surface 131*t* of the blade 131*b* contacts the basal front edge surface 163*t* of the protrusion 162, the body 161 (depicted in FIG. 5B) is disposed closer to the shaft 131*a* of the conveyance screw 131. When the helical outer circumferential surface 131*t* of the blade 131*b* contacts the convex front edge surface 164*t* of the protrusion 162, the body 161 is disposed away from the shaft 131*a* of the conveyance screw 131. Accordingly, when the helical outer circumferential surface 131*t* of the blade 131*b* contacts the basal front edge surface 163*t* and the convex front edge surface 164*t* of the protrusion 162 alternately, the comb tooth 160 of the agitator 16 swings in the direction M as illustrated in FIG. 5B.

When the basal front edge surface 163*t* of the protrusion 162 contacts the helical outer circumferential surface 131*t* of the blade 131*b* like the left protrusion 162 illustrated in FIG. 6A, the comb tooth 160 has a shape illustrated in a broken line in FIG. 5A. By contrast, when the convex front edge surface 164*t* of the protrusion 162 contacts the helical outer circumferential surface 131*t* of the blade 131*b* like the right protrusion 162 illustrated in FIG. 6A, the comb tooth 160 has a shape illustrated in a solid line in FIG. 5A.

A swing range of the comb tooth 160 corresponds to a length L1 of the convex portion 164, that is, a length between the basal front edge surface 163*t* and the convex front edge surface 164*t* in the protrusion direction E of the protrusion 162 as illustrated in FIG. 6B. The length L1 of the convex portion 164 is smaller than a height H of the blade 131*b* depicted in FIG. 6A, that is, a length between the helical outer circumferential surface 131*t* of the blade 131*b* and a surface of the shaft 131*a*.

As the conveyance screw 131 rotates, a contact position of the helical outer circumferential surface 131*t* of the blade 131*b* for contacting the protrusion 162 as illustrated by the left protrusion 162 in FIG. 6A moves downstream in the toner conveyance direction C in which the conveyance screw 131 conveys the collection toner T1, and reaches the convex upstream edge surface 164*s* of the protrusion 162 depicted in FIG. 6B. In the protrusion 162, the convex upstream edge surface 164*s* is sloped with respect to the basal front edge surface 163*t* and the protrusion direction E. Accordingly, the contact position of the helical outer circumferential surface 131*t* of the blade 131*b* for contacting the protrusion 162 moves downstream in the toner conveyance direction C while contacting and sliding over the convex upstream edge surface 164*s* of the protrusion 162. As the contact position of the helical outer circumferential surface 131*t* of the blade 131*b* for contacting the sloped, convex upstream edge surface 164*s* of the protrusion 162 moves downstream in the toner conveyance direction C, a force for separating the protrusion 162 from the shaft 131*a* of the conveyance screw 131 is applied to the protrusion 162. Accordingly, the body 161 depicted in FIG. 5A is bent substantially, and the comb tooth 160 depicted in FIG. 5A moves in a direction in which the comb tooth 160 separates from the shaft 131*a* of the conveyance screw 131.

When the contact position of the helical outer circumferential surface 131*t* of the blade 131*b* for contacting the protrusion 162 passes a downstream end of the convex upstream edge surface 164*s* in the toner conveyance direction C, the contact position of the helical outer circumferential surface 131*t* of the blade 131*b* for contacting the protrusion 162 contacts the convex front edge surface 164*t* as illustrated by the right protrusion 162 in FIG. 6A. As the conveyance screw 131 further rotates, the contact position of the helical outer circumferential surface 131*t* of the blade 131*b* for contacting the protrusion 162 moves to the convex downstream edge surface 164*e* of the protrusion 162. When the contact position of the helical outer circumferential surface 131*t* of the blade 131*b* for contacting the protrusion 162 passes a downstream end of the convex downstream edge surface 164*e* in the toner conveyance direction C, the force for bending the body 161 is not applied, and elasticity of the body 161 moves the protrusion 162 closer to the shaft 131*a* of the conveyance screw 131. The width W1 of the basal portion 163 in the axial direction of the conveyance screw 131 is greater than the helical pitch Pw of the blade 131*b*. Accordingly, another contact position of the helical outer circumferential surface 131*t* of the blade 131*b* for contacting the protrusion 162, which is provided upstream for the helical pitch Pw of the blade 131*b*, contacts the basal front edge surface 163*t* of the protrusion 162 as illustrated by the left protrusion 162 in FIG. 6A.

As illustrated in FIGS. 5B, 6A, and 6B, the agitator 16 contacts the conveyance screw 131. When the comb tooth 160 of the agitator 16 swings in coordination with rotation of the conveyance screw 131, the basal front edge surface 163*t*, the convex upstream edge surface 164*s*, the convex front edge surface 164*t*, and the convex downstream edge surface 164*e* of the comb tooth 160 contact the blade 131*b* of the conveyance screw 131. In other words, in the agitator 16, the protrusion front edge surface 162*t* including the basal front edge surface 163*t*, the convex upstream edge surface 164*s*, the convex front edge surface 164*t*, and the convex downstream edge surface 164*e* contacts the conveyance screw 131.

With the above-described structure in which the protrusion front edge surface 162*t* of the protrusion 162 contacts the helical outer circumferential surface 131*t* of the blade 131*b*, the width W1 of the basal portion 163 in the axial direction of the conveyance screw 131 is greater than the helical pitch Pw of the blade 131*b*. Accordingly, at least one edge surface (e.g., the basal front edge surface 163*t*, the convex upstream edge surface 164*s*, the convex front edge surface 164*t*, or the convex downstream edge surface 164*e*) of the protrusion front edge surface 162*t* of the protrusion 162 opposes the helical outer circumferential surface 131*t* of the blade 131*b* constantly. Further, in coordination with rotation of the conveyance screw 131, a contact portion of the protrusion front edge surface 162*t* of the protrusion 162 for contacting the helical outer circumferential surface 131*t* of the blade 131*b* moves among the basal front edge surface 163*t* of the basal portion 163 and the edge surfaces (e.g., the convex upstream edge surface 164*s*, the convex front edge surface 164*t*, and the convex downstream edge surface 164*e*) of the convex portion 164, which have varied distances from the body 161, respectively. Thus, the movement of the contact portion of the protrusion front edge surface 162*t* of the protrusion 162 for contacting the helical outer circumferential surface 131*t* of the blade 131*b* changes distance between the body 161 and the blade 131*b* of the conveyance screw 131, swinging the comb tooth 160 of the agitator 16.

In other words, the protrusion front edge surface 162*t* of the protrusion 162 of the comb tooth 160 opposes the helical outer circumferential surface 131*t* of the blade 131*b* of the conveyance screw 131 constantly to swing the comb tooth 160. Accordingly, in the comb tooth 160, only the protrusion front edge surface 162*t* of the protrusion 162 contacts the helical outer circumferential surface 131*t* of the blade 131*b* of the conveyance screw 131. Consequently, when the comb tooth 160 of the agitator 16 separates from the shaft 131*a* of the conveyance screw 131, the body 161 of the comb tooth 160 does not contact the conveyance screw 131 as in conventional agitators. Accordingly, when the comb tooth 160 disposed close to the shaft 131*a* of the conveyance screw 131 moves away from the shaft 131*a* of the conveyance screw 131, the blade 131*b* does not contact upstream edge surfaces of the comb tooth 160, which are the body upstream edge surface 161*s* of the body 161 and the basal upstream edge surface 163*s* of the protrusion 162. Consequently, the body upstream edge surface 161*s* and the basal upstream edge surface 163*s* of the comb tooth 160 are not hit and twanged by the blade 131*b*, suppressing noise generating in coordination with rotation of the conveyance screw 131.

The convex upstream edge surface 164*s* is not parallel to the protrusion direction E, but is tilted with respect to the protrusion direction E. Accordingly, when the contact position of the helical outer circumferential surface 131*t* of the blade 131*b* for contacting the protrusion 162 moves from the basal front edge surface 163*t* to the convex downstream edge surface 164*e* of the protrusion 162, the helical outer circumferential surface 131*t* of the blade 131*b* continues to contact the protrusion front edge surface 162*t* of the protrusion 162. Consequently, the convex upstream edge surface 164*s* of the protrusion 162 is not hit and twanged by the blade 131*b*. Further, when the blade 131*b* contacts the convex upstream edge surface 164*s* of the protrusion 162, noise may not generate.

In the toner conveyance device 130 according to this exemplary embodiment, when the contact position of the helical outer circumferential surface 131*t* of the blade 131*b* for contacting the protrusion 162 moves from the basal front edge surface 163*t* to the convex downstream edge surface 164*e* of the protrusion 162, the helical outer circumferential surface 131*t* of the blade 131*b* continues to contact the protrusion front edge surface 162*t* of the protrusion 162 until the contact position of the helical outer circumferential surface 131*t* of the blade 131*b* for contacting the protrusion 162 passes the downstream end of the convex downstream edge surface 164*e* of the protrusion 162 in the toner conveyance direction C. In other words, the contact position of the helical outer circumferential surface 131*t* of the blade 131*b* for contacting the protrusion 162 moves and slides over the protrusion front edge surface 162*t* of the protrusion 162.

As illustrated in FIG. 5B, the protrusion 162 of the agitator 16 protrudes from the body 161 in such a manner that the protrusion 162 is perpendicular to the body 161. Alternatively, the protrusion 162 may not be perpendicular to the body 161 as long as the contact position of the helical outer circumferential surface 131*t* of the blade 131*b* for contacting the protrusion 162 moves over the protrusion front edge surface 162*t* of the protrusion 162 to cause the protrusion 162 to transmit a force for changing a bending amount of the body 161 to the body 161. When the helical outer circumferential surface 131*t* of the blade 131*b* moves along a slope formed by the convex upstream edge surface 164*s* of the protrusion 162, the blade 131*b* applies a bending force to the protrusion 162 to bend the body 161 effectively, which is perpendicular to the protrusion 162. In other words, the bending force is applied most effectively when the protrusion direction in which the protrusion 162 protrudes forms a right angle with respect to a disposition direction in which the body 161 is disposed. As the protrusion direction of the protrusion 162 forms an acute angle or an obtuse angle with respect to the disposition direction of the body 161 so that the protrusion direction of the protrusion 162 becomes parallel to the disposition direction of the body 161, the bending force for bending the body 161 becomes smaller. Therefore, it may be preferable that the protrusion 162 is substantially perpendicular to the body 161.

Figure 7A:
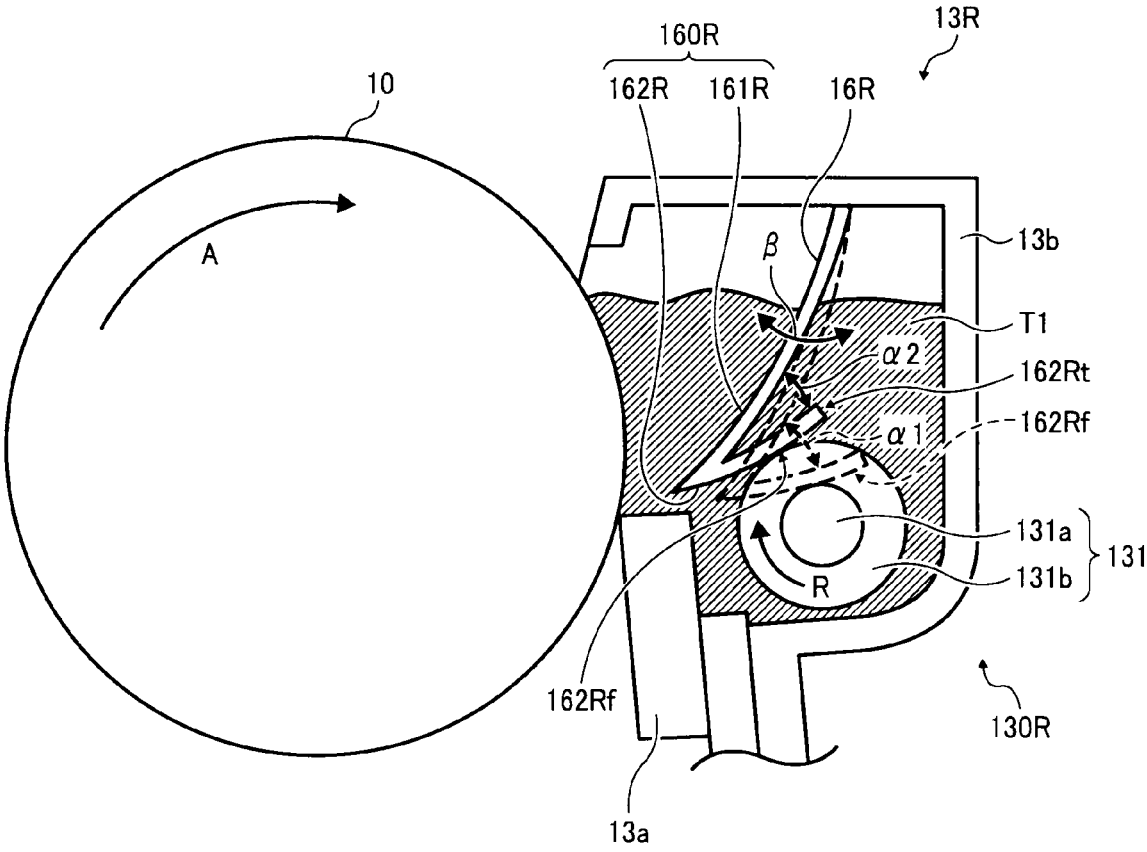
FIG. 7A is a sectional view of a photoconductor and a cleaner including a reference toner conveyance device.
Figure 7B:
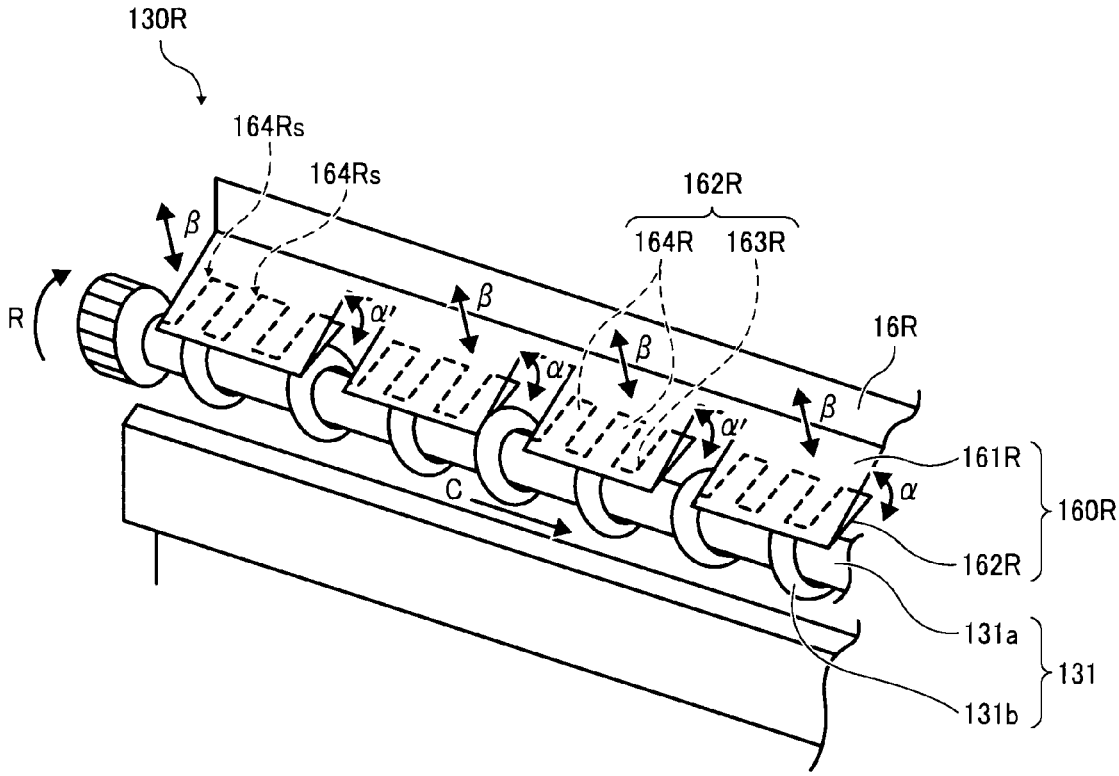
FIG. 7B is a perspective view of the reference toner conveyance device shown in FIG. 7A.

Referring to FIGS. 7A and 7B, the following describes a reference toner conveyance device 130R. FIG. 7A is a sectional view of the photoconductor 10 and a cleaner 13R including the reference toner conveyance device 130R. FIG. 7B is a perspective view of the reference toner conveyance device 130R included in the cleaner 13R. As illustrated in FIG. 7A, the reference toner conveyance device 130R includes an agitator 16R. The agitator 16R includes comb teeth 160R. Each of the comb teeth 160R includes a body 161R and a protrusion 162R. The protrusion 162R includes a screw opposing surface 162Rf and a protrusion front edge surface 162Rt. As illustrated in FIG. 7B, the protrusion 162R includes a basal portion 163R and a convex portion 164R. The convex portion 164R includes a convex upstream edge surface 164Rs.

In the reference toner conveyance device 130R, elements other than the agitator 16R are equivalent to the elements of the toner conveyance device 130 depicted in FIG. 5A. Accordingly, descriptions about the elements other than the agitator 16R are omitted.

As illustrated in FIG. 7A, a free end of the agitator 16R having a cantilever structure has a shape different from the shape of the free end of the agitator 16 depicted in FIG. 5A.

The comb-toothed agitator 16R formed of PET mylar and including a plurality of comb teeth 160R is pressed against the conveyance screw 131. The agitator 16R contacts the conveyance screw 131 and swings in coordination with rotation of the conveyance screw 131 to agitate collection toner T1.

Like the comb tooth 160 depicted in FIG. 5A, the comb tooth 160R of the agitator 16R includes the protrusion 162R, that is, a front portion of the agitator 16R which is bent at a front edge of the body 161R and contacts the conveyance screw 131. Like the protrusion 162 depicted in FIG. 6B, the protrusion 162R includes the basal portion 163R and the convex portion 164R. A width of the basal portion 163R in the axial direction of the conveyance screw 131 is greater than a helical pitch of the blade 131*b*. A width of the convex portion 164R in the axial direction of the conveyance screw 131 is smaller than the helical pitch of the blade 131*b*. However, a length of the protrusion 162R is greater than a length L2 of the protrusion 162 depicted in FIG. 6B. Unlike the protrusion front edge surface 162*t* depicted in FIG. 6B contacting the conveyance screw 131, the protrusion front edge surface 162Rt of the protrusion 162R depicted in FIG. 7A does not contact the conveyance screw 131, but the screw opposing surface 162Rf of the protrusion 162R contacts the conveyance screw 131. Further, unlike the protrusion 162 depicted in FIG. 6B having the single convex portion 164 corresponding to the single basal portion 163, the protrusion 162R includes a plurality of convex portions 164R corresponding to the single basal portion 163R. Unlike the convex portion 164 depicted in FIG. 6B having the length L1 smaller than the height H of the blade 131*b* depicted in FIG. 6A, the convex portion 164R has a length greater than the height H of the blade 131*b*. Accordingly, in the reference toner conveyance device 130R, the agitator 16R swinging in coordination with rotation of the conveyance screw 131 may be hit and twanged by the helical blade 131*b* and the shaft 131*a* of the conveyance screw 131, generating noise.

In the agitator 16 illustrated in FIGS. 5A, 5B, 6A, and 6B, when the agitator 16 contacts the helical blade 131*b* and swings, an angle formed by a bent portion of the agitator 16 forming a border between the body 161 and the protrusion 162 does not change, but the bending amount of the body 161 changes and the comb tooth 160 swings. The protrusion front edge surface 162*t* of the protrusion 162 constantly contacts the blade 131*b*. As the contact position of the helical outer circumferential surface 131*t* of the blade 131*b* for contacting the protrusion 162 moves and slides over the protrusion front edge surface 162*t* of the protrusion 162, the comb tooth 160 swings. The length L2 of the protrusion 162 in the protrusion direction E provides rigidity to prevent the protrusion 162 including a flexible material from being bent. In other words, even when the protrusion 162 is deformed, only the protrusion front edge surface 162*t* of the protrusion 162 contacts the helical outer circumferential surface 131*t* of the blade 131*b* of the conveyance screw 131. Accordingly, in the comb tooth 160, the body 161 swings in the direction M, but the protrusion 162 does not swing. Specifically, as the contact position of the helical outer circumferential surface 131*t* of the blade 131*b* for contacting the protrusion 162 moves over the protrusion front edge surface 162*t* of the protrusion 162, the body 161 swings. Consequently, the body 161 does not contact the blade 131*b*. Thus, the blade 131*b* does not contact the upstream edge surfaces of the comb tooth 160, which are the body upstream edge surface 161*s* of the body 161 and the basal upstream edge surface 163*s* of the protrusion 162. In other words, the body upstream edge surface 161*s* and the basal upstream edge surface 163*s* are not hit and twanged by the blade 131*b*.

Further, the convex upstream edge surface 164*s* of the protrusion 162 is sloped. While the contact position of the helical outer circumferential surface 131*t* of the blade 131*b* for contacting the protrusion 162 contacts the protrusion front edge surface 162*t* of the protrusion 162, the contact position of the helical outer circumferential surface 131*t* of the blade 131*b* for contacting the protrusion 162 moves and slides over the protrusion front edge surface 162*t* of the protrusion 162 from the basal front edge surface 163*t* of the basal portion 163 to the convex front edge surface 164*t*, that is, a front edge surface of the convex portion 164. Accordingly, when the contact position of the helical circumferential surface 131*t* of the blade 131*b* for contacting the protrusion 162 contacts the convex upstream edge surface 164*s* of the convex portion 164, the blade 131*b* does not push the convex portion 164 downstream in the toner conveyance direction C. Consequently, the convex upstream edge surface 164*s* of the convex portion 164 is not hit and twanged by the blade 131*b*.

As described above, the body upstream edge surface 161*s*, the basal upstream edge surface 163*s*, and the convex upstream edge surface 164*s* of the comb tooth 160 are not hit and twanged by the blade 131*b*. In other words, the upstream edge surfaces of each of the comb teeth 160 are not hit and twanged by the blade 131*b*. As a result, when the conveyance screw 131 rotates, the comb teeth 160 do not generate noise.

On the other hand, in the agitator 16R depicted in FIGS. 7A and 7B, the protrusion 162R has the substantially great length, and therefore has a small rigidity and is bent easily. Accordingly, when the comb tooth 160R contacts the helical blade 131*b* and swings, the bending amount of the body 161R changes and the body 161R swings in a direction β. Also, an angle α formed by the protrusion 162R with respect to the body 161R changes as indicated by an angle α1 and an angle α2. Consequently, the protrusion 162R also swings with respect to the body 161R.

When the protrusion 162R repeatedly moves between an upper position at which the protrusion 162R contacts the blade 131*b* of the conveyance screw 131 as illustrated in a solid line in FIG. 7A and a lower position at which the protrusion 162R enters a helical gap of the blade 131*b* as illustrated in a broken line in FIG. 7A, the angle α formed by the protrusion 162R with respect to the body 161R changes. When the protrusion 162R enters the helical gap of the blade 131*b*, the helical blade 131*b* enters a gap between the adjacent screw opposing surfaces 162Rf of the protrusion 162R opposing the conveyance screw 131. Accordingly, the helical outer circumferential surface 131*t* (depicted in FIG. 6A) of the helical blade 131*b* does not contact the protrusion front edge surface 162Rt serving as a free end edge surface of the agitator 16R. Thus, the agitator 16R does not swing while the helical outer circumferential surface 131*t* of the blade 131*b* contacts the protrusion front edge surface 162Rt of the agitator 16R constantly. In other words, the blade 131*b* moves in and out of virtual surfaces including the screw opposing surface 162Rf of the protrusion 162R opposing the conveyance screw 131. Accordingly, the blade 131*b* hits and twangs the convex upstream edge surface 164Rs of the convex portion 164R (depicted in FIG. 7B) including the screw opposing surface 162Rf of the protrusion 162R, generating noise.

As illustrated in FIG. 7B, the convex portion 164R has a great length, and therefore contacts the shaft 131*a* of the conveyance screw 131 when the basal portion 163R contacts the blade 131*b*. Accordingly, when the shaft 131*a* hits and twangs the convex portion 164R, the convex portion 164R generates noise.

Due to market demand for image forming apparatuses such as copiers and printers for forming a color image at high speed by electrophotography, tandem image forming apparatuses including four photoconductors like the image forming apparatus 100 depicted in FIG. 3 are widely used. However, in the tandem image forming apparatus, four image forming units, each of which includes a photoconductor, a charger, a development device, and a cleaner, are arranged. Further, an intermediate transfer belt or a transfer belt corresponding to the four image forming units is disposed. In other words, the tandem image forming apparatus includes more units inside a machine body than conventional image forming apparatuses, resulting in the large size image forming apparatus. To address this, a compact image forming apparatus occupying a small space is needed. However, the compact image forming apparatus including many image forming units inside a compact machine body can accommodate fewer air current channels, and therefore cannot cool an inside of the machine body effectively, resulting in temperature increase of the inside of the machine body. The temperature increase of the inside of the machine body may degrade toner flowability inside the image forming units. Accordingly, toner, which is not conveyed smoothly, may build up inside the image forming units and may clog the image forming units.

Figure 2A:
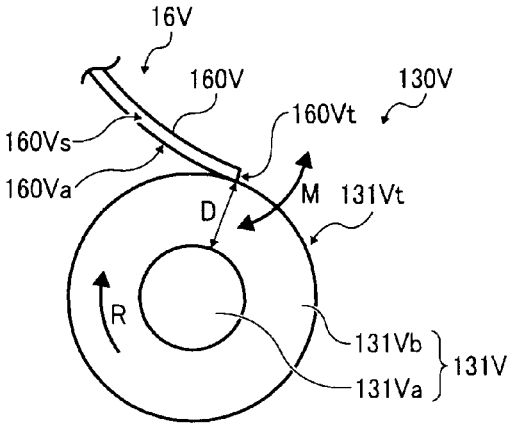
FIG. 2A RELATED ART
FIG. 2A is a sectional view of the related art toner conveyance device shown in FIG. 1 seen in a direction S in FIG. 1.
Figure 2B:
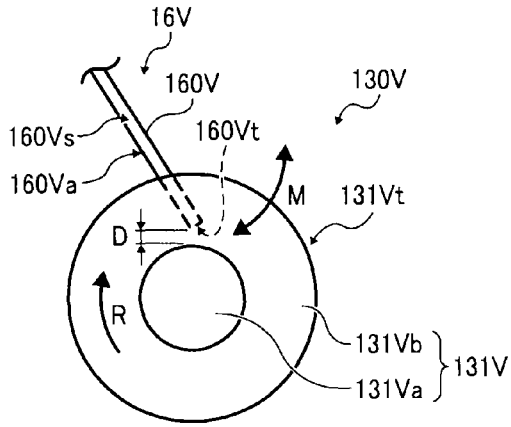
FIG. 2B RELATED ART
FIG. 2B is another sectional view of the related art toner conveyance device shown in FIG. 1 seen in a direction S in FIG. 1.

To address this, the conventional image forming apparatus may include the toner conveyance device 130V depicted in FIGS. 1, 2A, and 2B, in which the agitator 16V including a flexible material such as PET mylar contacts the conveyance screw 131V, and swings in coordination with rotation of the conveyance screw 131V to agitate toner.

However, in the conventional toner conveyance device 130V, the comb tooth 160V of the agitator 16V repeatedly moves between an upper position at which the comb tooth 160V is pushed up by the blade 131Vb of the conveyance screw 131V while contacting the conveyance screw 131V and a lower position at which the comb tooth 160V enters a helical gap of the helical blade 131Vb. Accordingly, the comb tooth 160V swings, and the upstream edge surface 160Vs of the comb tooth 160V in the toner conveyance direction C is hit and twanged by the blade 131Vb of the conveyance screw 131V, generating noise.

By contrast, in the toner conveyance device 130 according to this exemplary embodiment depicted in FIG. 5B, the body upstream edge surface 161*s* of each of the comb teeth 160 is not hit and twanged by the blade 131*b* of the conveyance screw 131, suppressing noise.

Figure 8:
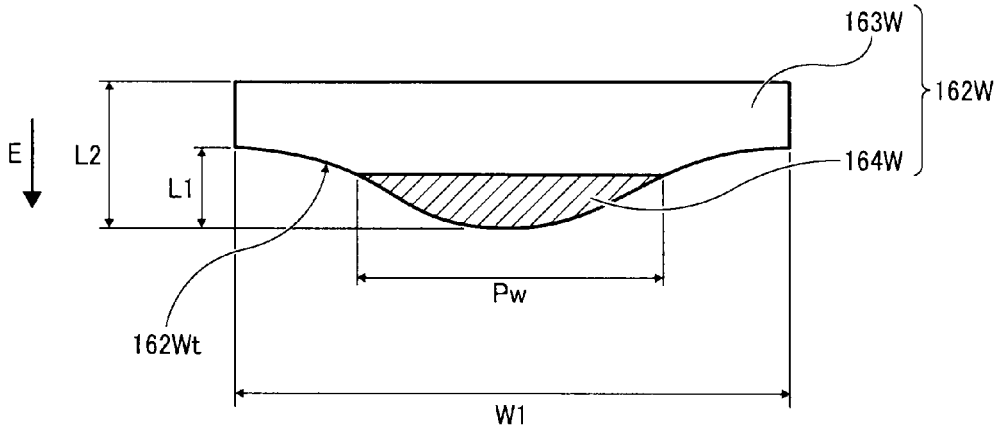
FIG. 8 is an enlarged view of another example of the protrusion shown in FIG. 6B.

The protrusion 162 of the agitator 16 may have a shape other than the shape illustrated in FIG. 6B. FIG. 8 illustrates a protrusion 162W having a shape different from the shape of the protrusion 162 depicted in FIG. 6B. FIG. 8 is an enlarged view of the protrusion 162W. As illustrated in FIG. 8, the protrusion 162W includes a protrusion front edge surface 162Wt, a basal portion 163W, and a convex portion 164W.

The hatched convex portion 164W serves as a front portion of the protrusion 162W in the protrusion direction E. A width of the convex portion 164W in the axial direction of the conveyance screw 131 depicted in FIG. 5B is smaller than the helical pitch Pw of the blade 131*b* depicted in FIG. 6A. The basal portion 163W serves as a portion of the protrusion 162W other than the convex portion 164W and has the width W1 greater than the helical pitch Pw of the blade 131*b* in the axial direction of the conveyance screw 131.

The protrusion front edge surface 162Wt is provided on a front edge of the protrusion 162W to contact the helical outer circumferential surface 131*t* of the blade 131*b* of the conveyance screw 131 depicted in FIG. 6A. A distance between the protrusion front edge surface 162Wt of the protrusion 162W and the body 161 depicted in FIG. 5B changes in the toner conveyance direction C along the protrusion front edge surface 162Wt of the protrusion 162W.

Figure 9:
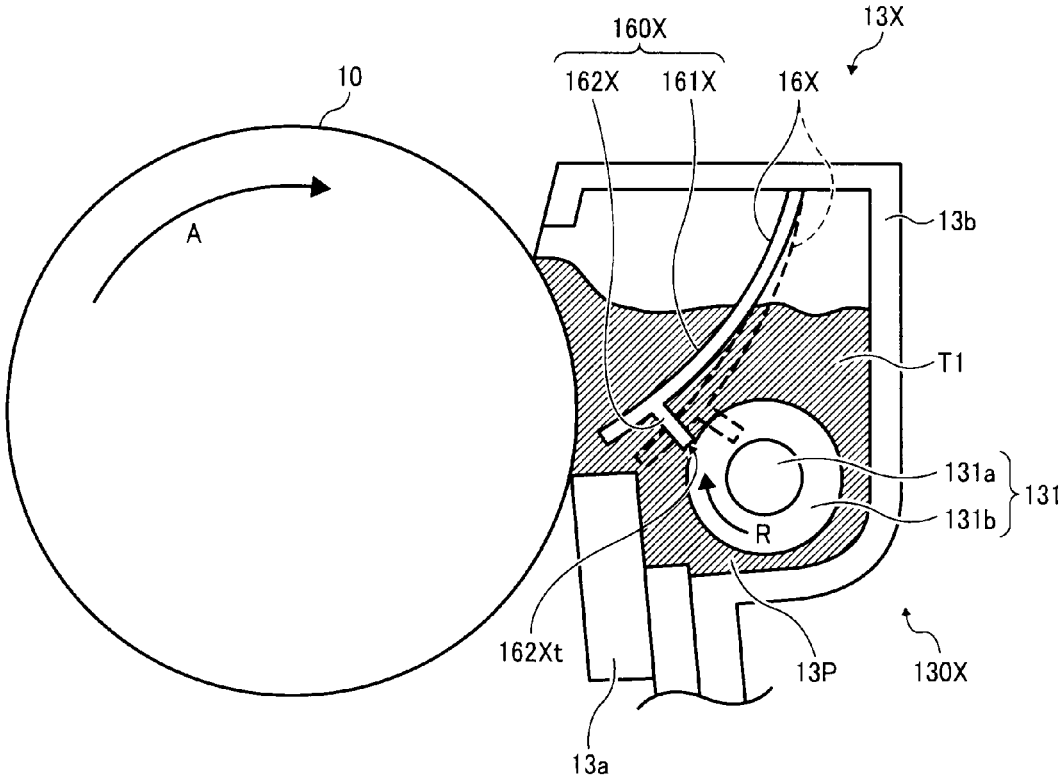
FIG. 9 is a sectional view of a cleaner according to another exemplary embodiment of the present invention.

In the comb tooth 160 of the agitator 16 depicted in FIG. 5B, the protrusion 162 is provided on a front edge of the body 161. Alternatively, the protrusion 162 may be provided on other position as illustrated by a protrusion 162X in FIG. 9. FIG. 9 is a sectional view of a cleaner 13X and the photoconductor 10. As illustrated in FIG. 9, the cleaner 13X includes a toner conveyance device 130X. The toner conveyance device 130X includes an agitator 16X. The agitator 16X includes a comb tooth 160X. The comb tooth 160X includes a body 161X and the protrusion 162X. The protrusion 162X includes a protrusion front edge surface 162Xt. The other elements of the cleaner 13X are equivalent to the elements of the cleaner 13 depicted in FIG. 5A.

The protrusion 162X is provided not on a front edge of the body 161X but near the front edge of the body 161X. Namely, the protrusion 162X may be provided at any position on a free end of the body 161X as long as the protrusion front edge surface 162Xt provided on a front edge of the protrusion 162X contacts the blade 131*b* and therefore the body 161X swings.

In the agitator 16 depicted in FIG. 5B, the protrusion 162 is provided on the front edge of the body 161 of the comb tooth 160. Accordingly, a swing width of the agitator 16 is equivalent to the length L1 of the convex portion 164 depicted in FIG. 6B and is smaller than the height H of the blade 131*b* depicted in FIG. 6A. Consequently, the agitator 16 may agitate collection toner T1 in a restricted region.

To address this, a second agitator, which contacts the agitator 16 and swings in coordination with swinging of the agitator 16, may be provided to agitate the collection toner T1 in a region greater than the region in which the agitator 16 agitates the collection toner T1 so as to improve toner agitation performance of the toner conveyance device 130.

Figure 10A:
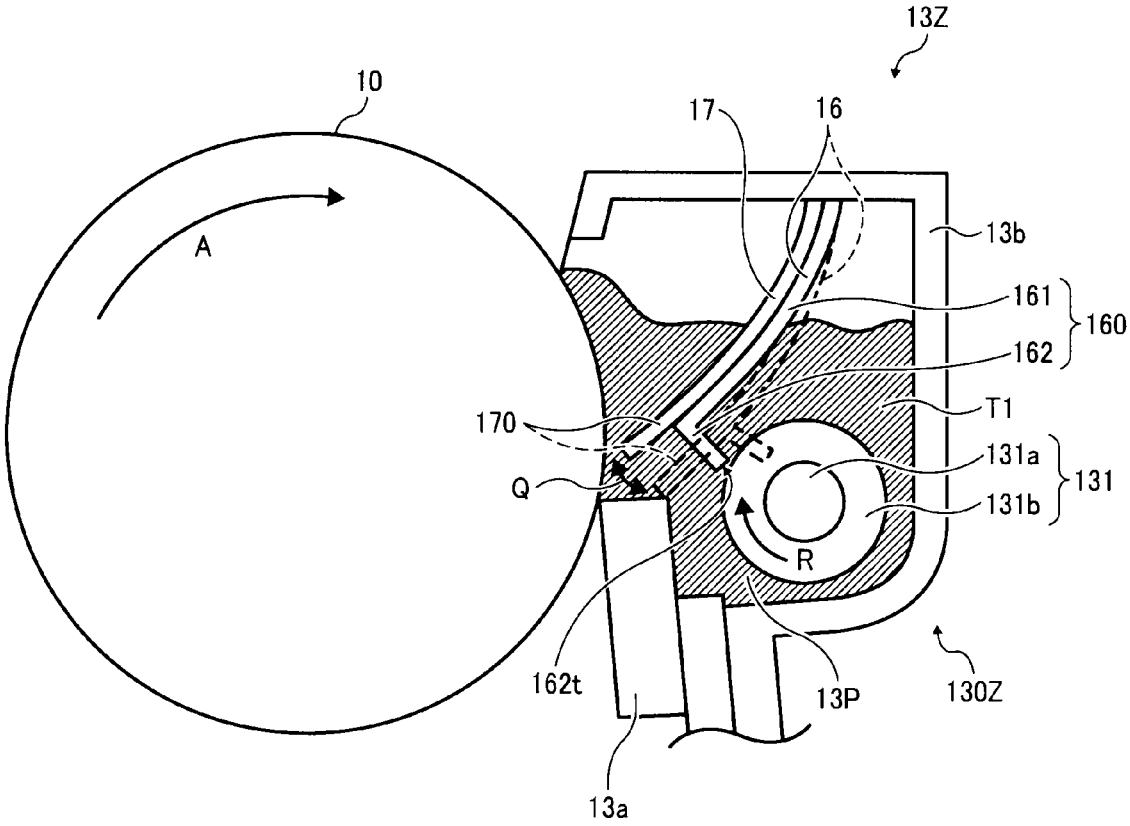
FIG. 10A is a sectional view of a cleaner according to yet another exemplary embodiment of the present invention.
Figure 10B:
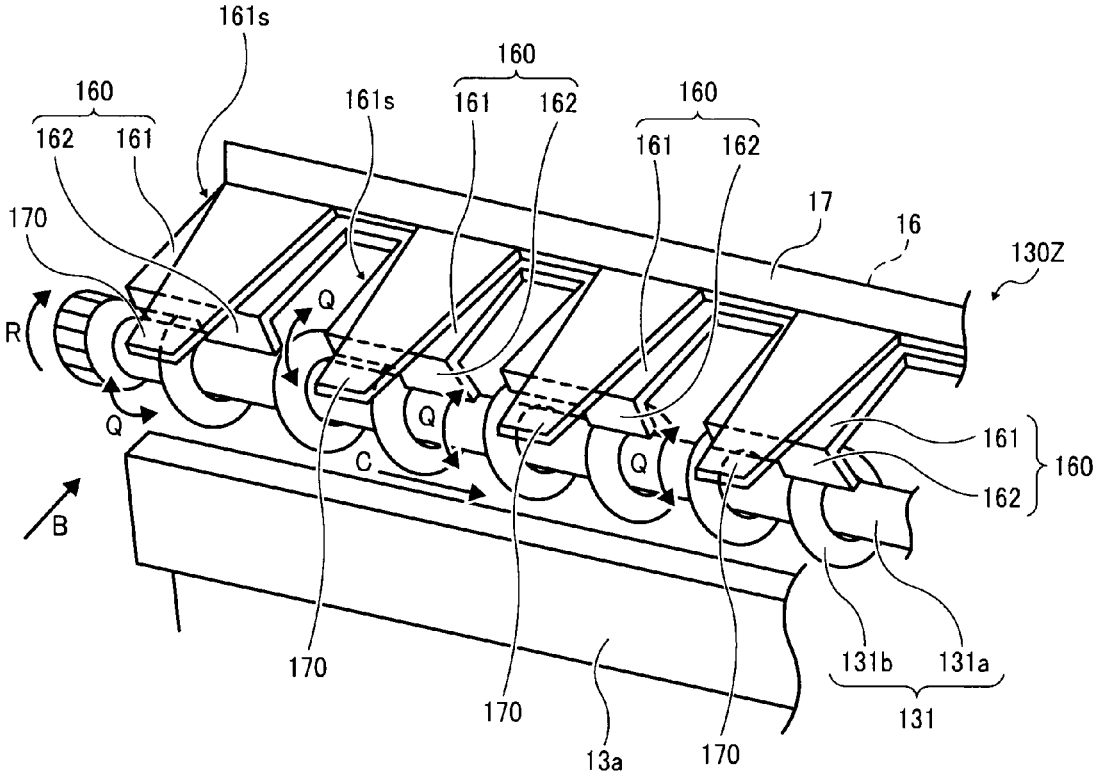
FIG. 10B is a perspective view of a toner conveyance device included in the cleaner shown in FIG. 10A.

Referring to FIGS. 10A and 10B, the following describes a toner conveyance device 130Z including the second agitator. FIG. 10A is a sectional view of a cleaner 13Z and the photoconductor 10. FIG. 10B is a perspective view of the toner conveyance device 130Z included in the cleaner 13Z. As illustrated in FIG. 10A, the toner conveyance device 130Z includes a second agitator 17. The second agitator 17 includes second comb teeth 170. The other elements of the toner conveyance device 130Z are equivalent to the elements of the toner conveyance device 130 depicted in FIG. 5A.

The second agitator 17 contacts the agitator 16 serving as a first agitator, and swings in coordination with swinging of the agitator 16. The second agitator 17 is provided on the agitator 16.

The second agitator 17 includes a plate member formed of a flexible material and has a cantilever structure. As illustrated in FIG. 10B, a plurality of second comb teeth 170 is provided on a free end of the cantilever structure of the second agitator 17 in such a manner that the second agitator 17 has a comb shape. When the free end of the second agitator 17 swings, the second agitator 17 agitates collection toner T1 inside the casing 13*b*. Like the agitator 16, the second agitator 17 includes PET mylar. Alternatively, the second agitator 17 may include other flexible material.

A fixed end of the cantilevered second agitator 17 is attached to a fixed end of the agitator 16 in such a manner that the fixed end of the second agitator 17 is provided (e.g., layered) on the fixed end of the agitator 16. In other words, a swing axis of the second agitator 17 substantially coincides with a swing axis of the agitator 16.

As illustrated in FIG. 10B, the second comb teeth 170 of the second agitator 17 are provided (e.g., layered) on the comb teeth 160 of the agitator 16. When the comb teeth 160 swing in the direction M depicted in FIG. 5B, the second comb teeth 170 swing in a direction Q depicted in FIG. 10B.

The free end of the second agitator 17 contacting the body 161 of the agitator 16 extends from the front edge of the body 161. Accordingly, the free end of the second agitator 17 has a swing radius greater than a swing radius of the body 161 of the agitator 16.

In the toner conveyance device 130Z depicted in FIG. 10B, when the agitator 16 swings in coordination with rotation of the conveyance screw 131, the second agitator 17 swings about the swing axis substantially identical with the swing axis of the agitator 16 in such a manner that a contact portion of the second agitator 17 contacting the agitator 16 remains unchanged substantially. The free end of the second agitator 17 extends from the contact portion thereof and therefore is longer than the free end of the agitator 16. Accordingly, the free end of the second agitator 17 has the swing radius greater than the swing radius of the body 161 of the agitator 16. Consequently, a swing width of the second agitator 17 is greater than a swing width of the agitator 16. Namely, the agitator 16 and the second agitator 17 of the toner conveyance device 130Z agitate the collection toner T1 in a region greater than the region in which the agitator 16 of the toner conveyance device 130 depicted in FIG. 5A agitates the collection toner T1, improving toner agitation efficiency.

As described above, like the toner conveyance device 130, the toner conveyance device 130Z suppresses noise generating in coordination with rotation of the conveyance screw 131. Further, the toner conveyance device 130Z provides improved toner agitation efficiency compared to the toner conveyance device 130.

In the agitator 16V of the conventional toner conveyance device 130V depicted in FIG. 1, a convex portion, which enters the helical gap of the helical blade 131Vb of the conveyance screw 131V, has a comb tooth shape. However, a basal portion provided on a fixed end of the agitator 16V is not divided in an axial direction of the conveyance screw 131V. In other words, only the convex portion of the agitator 16V has the comb tooth shape. Accordingly, the basal portion of the agitator 16V has a substantial rigidity and is hardly bent. Namely, only the convex portion of the agitator 16V swings. Thus, the agitator 16V swings in a small region, providing degraded toner agitation performance.

By contrast, in the agitator 16 depicted in FIGS. 5A and 10A or the agitator 16X depicted in FIG. 9, the fixed end of the agitator 16 or 16X, which does not enter the helical gap of the blade 131*b* of the conveyance screw 131, has the comb tooth shape. Accordingly, each of the comb teeth 160 or 160X has a small rigidity and is bent easily. Consequently, the agitator 16 or 16X swings from a position near the fixed end thereof. Thus, the agitator 16 or 16X agitates the collection toner T1 in a greater swing region, improving toner agitation performance.

In the toner conveyance device 130 depicted in FIG. 5A, the toner conveyance device 130X depicted in FIG. 9, or the toner conveyance device 130Z depicted in FIG. 10A, the conveyance screw 131 serving as a conveyance member has a screw shape in which the helical blade 131*b* is fixedly mounted on the shaft 131*a*. Alternatively, the conveyance member may include the helical blade 131*b* and may not include the shaft 131*a*.

As described above, the toner conveyance device 130 depicted in FIG. 5A, the toner conveyance device 130X depicted in FIG. 9, or the toner conveyance device 130Z depicted in FIG. 10A includes the casing 13*b*, the conveyance screw 131, and the agitator 16 or 16X. The casing 13*b* serves as a conveyance path formation member for forming the conveyance path 13P to convey collection toner T1 collected by the cleaning blade 13*a* serving as a cleaning member of the cleaner 13, 13X, or 13Z. The conveyance screw 131 includes the helical blade 131*b* and serves as a conveyance member for rotating and conveying the collection toner T1 contained in the casing 13*b* in one direction in the axial direction of the conveyance screw 131. The agitator 16 or 16X serves as a first agitator for swinging in coordination with rotation of the conveyance screw 131 and agitating the collection toner T1 contained in the casing 13*b*.

The agitator 16 or 16X includes a comb-toothed plate member formed of a flexible material and has the cantilever structure bent in a direction perpendicular to the axial direction of the conveyance screw 131. The agitator 16 or 16X contacts the blade 131*b* of the conveyance screw 131 and swings in coordination with rotation of the conveyance screw 131 so that a bending amount of the cantilevered agitator 16 or 16X changes. Thus, the agitator 16 or 16X agitates the collection toner T1 contained in the casing 13*b*.

The agitator 16 or 16X includes the comb teeth 160 or 160X, respectively. Each of the comb teeth 160 or 160X includes the body 161 or 161X and the protrusion 162, 162W, or 162X, respectively. The body 161 or 161X serves as a cantilevered plate member for swinging in such a manner that a bending amount of the body 161 or 161X changes. The protrusion 162, 162W, or 162X protrudes from the body 161 or 161X in the protrusion direction E opposite to a bending direction in which the body 161 or 161X bends. The protrusion front edge surface 162*t*, 162Wt, or 162Xt is provided on a front edge of the protrusion 162, 162W, or 162X in the protrusion direction E of the protrusion 162, 162W, or 162X, respectively, and contacts the helical outer circumferential surface 131*t* provided on a helical outer circumferential edge of the blade 131*b*.

When the protrusion front edge surface 162*t*, 162Wt, or 162Xt of the protrusion 162, 162W, or 162X, respectively, receives a force applied by the conveyance screw 131 to the body 161 or 161X, the body 161 or 161X is bent by the force.

The protrusion 162, 162W, or 162X includes the basal portion 163 or 163W and the convex portion 164 or 164W, respectively. The basal portion 163 or 163W is adjacent and connected to the body 161 or 161X, and is provided closer to the body 161 or 161X than the convex portion 164 or 164W is in the protrusion direction E of the protrusion 162, 162W, or 162X. The width W1 of the basal portion 163 or 163W in the axial direction of the conveyance screw 131 is greater than the helical pitch Pw of the blade 131*b* of the conveyance screw 131. The convex portion 164 or 164W is provided in a front portion of the protrusion 162, 162W, or 162X in the protrusion direction E of the protrusion 162, 162W, or 162X. The width W2 of the convex portion 164 or 164W in the axial direction of the conveyance screw 131 is smaller than the helical pitch Pw of the blade 131*b* of the conveyance screw 131. The basal front edge surface 163*t* of the basal portion 163 or 163W and a plurality of edge surfaces of the convex portion 164 or 164W (e.g., the convex upstream edge surface 164*s*, the convex front edge surface 164*t*, and the convex downstream edge surface 164*e* forming the protrusion front edge surface 162*t*, 162Wt, or 162Xt) contact the helical outer circumferential surface 131*t* of the blade 131*b* of the conveyance screw 131. Accordingly, the basal portion 163 or 163W does not enter the helical gap of the blade 131*b*, but the convex portion 164 or 164W enters the helical gap of the blade 131*b*. Specifically, the convex portion 164 or 164W repeatedly moves between a lower position at which the convex portion 164 or 164W enters the helical gap of the blade 131*b* and therefore the basal front edge surface 163*t* of the basal portion 163 or 163W contacts the helical outer circumferential surface 131*t* of the blade 131*b* and an upper position at which the convex portion 164 or 164W gets out of the helical gap of the blade 131*b* and therefore the convex front edge surface 164*t* of the convex portion 164 or 164W contacts the helical outer circumferential surface 131*t* of the blade 131*b*. Accordingly, the comb tooth 160 or 160X swings within the length L1 of the convex portion 164 or 164W.

Further, an upstream edge surface of the protrusion front edge surface 162*t*, 162Wt, or 162Xt of the protrusion 162, 162W, or 162X, respectively, in the toner conveyance direction C in which the conveyance screw 131 conveys the collection toner T1 is the basal front edge surface 163*t*. Accordingly, a contact position of the helical outer circumferential surface 131*t* of the blade 131*b* for contacting the protrusion front edge surface 162*t*, 162Wt, or 162Xt of the protrusion 162, 162W, or 162X, respectively, moves downstream in the toner conveyance direction C in coordination with rotation of the conveyance screw 131. Specifically, when the contact position of the helical outer circumferential surface 131*t* of the blade 131*b* for contacting the protrusion front edge surface 162*t*, 162Wt, or 162Xt of the protrusion 162, 162W, or 162X, respectively, passes the convex downstream edge surface 164*e* serving as a downstream edge surface of the protrusion front edge surface 162*t*, 162Wt, or 162Xt, the basal front edge surface 163*t*, which is provided upstream from the convex downstream edge surface 164*e* in the toner conveyance direction C, contacts the helical outer circumferential surface 131*t* of the blade 131*b*.

The convex upstream edge surface 164*s* is tilted with respect to the protrusion direction E. Accordingly, a distance between the body 161 or 161X and the protrusion front edge surface 162*t*, 162Wt, or 162Xt of the protrusion 162, 162W, or 162X, respectively, changes depending on the basal front edge surface 163*t* provided upstream from the convex portion 164 or 164W in the toner conveyance direction C, the convex upstream edge surface 164*s*, and the convex front edge surface 164*t*. Consequently, while the helical outer circumferential surface 131*t* of the blade 131*b* contacts the protrusion front edge surface 162*t*, 162Wt, or 162Xt of the protrusion 162, 162W, or 162X, respectively, the contact position of the helical outer circumferential surface 131*t* of the blade 131*b* for contacting the protrusion front edge surface 162*t*, 162Wt, or 162Xt of the protrusion 162, 162W, or 162X, respectively, moves and slides over the protrusion front edge surface 162*t*, 162Wt, or 162Xt from the basal front edge surface 163*t* to the convex front edge surface 164*t*. In other words, in coordination with rotation of the conveyance screw 131, a contact portion of the protrusion front edge surface 162*t*, 162Wt, or 162Xt of the protrusion 162, 162W, or 162X, respectively, for contacting the helical outer circumferential surface 131*t* of the blade 131*b* moves from the basal front edge surface 163*t* to the convex front edge surface 164*t*. A distance between the body 161 or 161X and the basal front edge surface 163*t* of the basal portion 163 or 163W is different from a distance between the body 161 or 161X and the convex front edge surface 164*t* of the convex portion 164 or 164W. The movement of the contact portion of the protrusion front edge surface 162*t*, 162Wt, or 162Xt of the protrusion 162, 162W, or 162X, respectively, for contacting the helical outer circumferential surface 131*t* of the blade 131*b* changes a distance between the body 161 or 161X and the shaft 131*a* of the conveyance screw 131. Accordingly, the comb tooth 160 or 160X of the agitator 16 or 16X swings.

The comb tooth 160 or 160X swings in a state in which the protrusion front edge surface 162*t*, 162Wt, or 162Xt of the protrusion 162, 162W, or 162X, respectively, constantly opposes the helical outer circumferential surface 131*t* of the blade 131*b*. Therefore, in the agitator 16 or 16X, only the protrusion front edge surface 162*t*, 162Wt, or 162Xt of the protrusion 162, 162W, or 162X, respectively, contacts the helical outer circumferential surface 131*t* of the blade 131*b*. Further, the contact position of the helical outer circumferential surface 131*t* of the blade 131*b* for contacting the protrusion front edge surface 162*t*, 162Wt, or 162Xt of the protrusion 162, 162W, or 162X, respectively, moves from the basal front edge surface 163*t* to the convex front edge surface 164*t* in such a manner that the contact position of the helical outer circumferential surface 131*t* of the blade 131*b* for contacting the protrusion front edge surface 162*t*, 162Wt, or 162Xt of the protrusion 162, 162W, or 162X slides over the protrusion front edge surface 162*t*, 162Wt, or 162Xt, respectively. Accordingly, when the blade 131*b* contacts the convex upstream edge surface 164*s* of the convex portion 164 or 164W, the blade 131*b* may not push the convex portion 164 or 164W downward in the toner conveyance direction C. Consequently, when the comb tooth 160 or 160X of the agitator 16 or 16X swings as the basal front edge surface 163*t* of the comb tooth 160 or 160X moves closer to the shaft 131*a* of the conveyance screw 131 to contact the helical outer circumferential surface 131*t* of the blade 131*b* of the conveyance screw 131 and moves away from the shaft 131*a* of the conveyance screw 131 to cause the convex front edge surface 164*t* of the comb tooth 160 or 160X to contact the helical outer circumferential surface 131*t* of the blade 131*b*, the body upstream edge surface 161*s* and the basal upstream edge surface 163*s* of the comb tooth 160 or 160X may not be hit and twanged by the blade 131*b*. As a result, when the conveyance screw 131 rotates, noise may not generate.

In the agitator 16 of the toner conveyance device 130 depicted in FIGS. 5A, 5B, 6A, and 6B, a front portion near a front edge of the comb tooth 160 serving as a cantilevered plate member is angled or bent. The angled front portion of the comb tooth 160 serves as the protrusion 162. In other words, simple processing for angling or bending the front portion of the plate member forms the protrusion 162 which transmits a force generated by rotation of the conveyance screw 131 in a direction for bending the comb tooth 160 when the protrusion 162 contacts the conveyance screw 131 at various surfaces, which are the basal front edge surface 163*t*, the convex upstream edge surface 164*s*, the convex front edge surface 164*t*, and the convex downstream edge surface 164*e*.

As illustrated in FIG. 6A, the toner conveyance device 130, 130X, or 130Z includes the conveyance screw 131 having a screw shape in which the helical blade 131*b* is fixedly mounted on the shaft 131*a* extending in the axial direction of the conveyance screw 131. As illustrated in FIGS. 6A and 6B, the length L1 from a border between the basal portion 163 and the convex portion 164 to the convex front edge surface 164*t* of the convex portion 164 in the protrusion direction E of the protrusion 162 is smaller than the height H of the blade 131*b* from the helical outer circumferential surface 131*t* of the blade 131*b* to the surface of the shaft 131*a*. Accordingly, even when the basal front edge surface 163*t* of the comb tooth 160 contacts the helical outer circumferential surface 131*t* of the blade 131*b* and therefore the comb tooth 160 is disposed closer to the shaft 131*a* of the conveyance screw 131, the convex portion 164 does not contact the shaft 131*a*. Consequently, the convex portion 164 may not be hit and twanged by the shaft 131*a*, suppressing noise.

With the above-described structure, the length L1 of the convex portion 164 is smaller than the height H of the blade 131*b*. Alternatively, a front edge of the protrusion 162 of the agitator 16 for contacting the conveyance screw 131 may swing without contacting the shaft 131*a* of the conveyance screw 131. Thus, the agitator 16 may not be hit and twanged by the shaft 131*a*, suppressing noise.

When the protrusion 162 protrudes from the body 161 toward a rotation axis of the conveyance screw 131 in the protrusion direction E, the convex portion 164 of the protrusion 162 may contact the shaft 131*a* if the length L1 of the convex portion 164 is greater than the height H of the blade 131*b*. However, when the protrusion direction E of the protrusion 162 protruding from the body 161 is tilted with respect to a direction in which the protrusion 162 protrudes toward the rotation axis of the conveyance screw 131, the convex portion 164 of the protrusion 162 may not contact the shaft 131*a* even if the length L1 of the convex portion 164 is greater than the height H of the blade 131*b*.

As illustrated in FIGS. 5A and 9, the protrusion 162 or 162X of the agitator 16 or 16X, respectively, protrudes toward the shaft 131*a* of the conveyance screw 131. In other words, the free end of the agitator 16 or 16X is bent toward the rotation axis of the conveyance screw 131. Thus, even when the length L1 of the convex portion 164 of the bent agitator 16 or 16X is equivalent to the length L1 of the convex portion 164 of a straight agitator (e.g., an agitator not bent) and both the bent agitator 16 or 16X and the straight agitator include the protrusions 162 having an identical shape, the bent agitator 16 or 16X provides a greater swing width than the straight agitator, improving swing efficiency.

Even with the above-described shape of the agitator 16 or 16X, when the protrusion 162 or 162X has a shape in which the length L1 from the border between the basal portion 163 and the convex portion 164 to the convex front edge surface 164*t* or 164Xt of the convex portion 164 is smaller than the height H of the blade 131*b*, the basal front edge surface 163*t* of the basal portion 163 contacts the helical outer circumferential surface 131*t* of the blade 131*b*. Accordingly, even when the comb tooth 160 or 160X moves closer to the shaft 131*a* of the conveyance screw 131, the convex portion 164 of the comb tooth 160 or 160X does not contact the shaft 131*a* of the conveyance screw 131. In other words, even when the free end of the agitator 16 or 16X is bent toward the rotation axis of the conveyance screw 131 to improve swing efficiency, the convex portion 164 or 164W of the agitator 16 or 16X having the length L1 smaller than the height H of the blade 131*b* of the conveyance screw 131 may not be hit and twanged by the shaft 131*a* of the conveyance screw 131, suppressing noise.

As illustrated in FIGS. 10A and 10B, in the toner conveyance device 130Z including the second agitator 17 for contacting the agitator 16 and swinging in coordination with swinging of the agitator 16, the swinging agitator 16 swings the second agitator 17 with the swing width greater than the swing width of the agitator 16. Thus, the agitator 16 and the second agitator 17 agitate collection toner T1 in an increased agitation region, improving toner agitation efficiency.

The second agitator 17 includes a cantilevered, comb-toothed plate member formed of a flexible material. When the free end of the cantilevered second agitator 17 swings, the second agitator 17 agitates the collection toner T1. The swing width of the second comb tooth 170 provided on the free end of the second agitator 17 is greater than the swing width of the free end of the body 161 of the comb tooth 160 of the agitator 16. Thus, when the comb tooth 160 of the agitator 16 swings, the second comb tooth 170 of the second agitator 17 also swings. The swing width of the second comb tooth 170 greater than the swing width of the free end of the body 161 causes the swing width of the second agitator 17 to be greater than the swing width of the agitator 16.

A position of the fixed end of the cantilevered agitator 16 substantially coincides with a position of the fixed end of the cantilevered second agitator 17. In other words, the swing axis of the second agitator 17 substantially coincides with the swing axis of the agitator 16. Accordingly, the agitator 16 and the second agitator 17 swing in such a manner that the contact portion of the second agitator 17 contacting the agitator 16 remains unchanged substantially. Consequently, the swing width of the contact portion of the second agitator 17 contacting the agitator 16 is greater than the swing width of the agitator 16, improving toner agitation efficiency.

The second agitator 17 constantly contacts the agitator 16 and swings. Accordingly, the swing width of the second agitator 17 with respect to the swing width of the agitator 16 is greater than a swing width of the second agitator 17 which swings by contacting and separating to and from the agitator 16, improving toner agitation efficiency.

As illustrated in FIG. 3, the image forming apparatus 100 includes the photoconductors 10Y, 10C, 10M, and 10K, the development devices 12Y, 12C, 12M, and 12K, the transfer belt 20, the first transfer rollers 24Y, 24C, 24M, and 24K, and the cleaners 13Y, 13C, 13M, and 13K.

The photoconductors 10Y, 10C, 10M, and 10K serve as an image carrier. The development devices 12Y, 12C, 12M, and 12K serve as a development device for developing a latent image formed on the image carrier with toner to form a toner image. The transfer belt 20 serves as an intermediate transfer member. The first transfer rollers 24Y, 24C, 24M, and 24K serve as a transferor for transferring the toner image formed on the image carrier onto the intermediate transfer member. The cleaners 13Y, 13C, 13M, and 13K serve as a cleaner for collecting residual toner (e.g., the collection toner T1) remaining on the image carrier after the toner image is transferred onto the intermediate transfer member.

As illustrated in FIGS. 5A, 9, and 10A, each of the cleaners 13Y, 13C, 13M, and 13K serving as the cleaner includes the casing 13*b*, and the toner conveyance device 130, 130X, or 130Z. The casing 13*b* serves as a housing of the cleaner. The toner conveyance device 130, 130X, or 130Z serves as a toner conveyance device for conveying the collection toner T1 inside the housing. The toner conveyance device includes the conveyance screw 131 serving as a conveyance member for conveying the collection toner T1. By including the toner conveyance device having the above-described structures and features, the cleaner can prevent or reduce the collection toner T1 clogged in the cleaner and noise generating in coordination with rotation of the conveyance member.

When the development device of the image forming apparatus uses polymerization toner, the toner image is transferred effectively, resulting in a high-quality toner image.

The conveyance screw 131 conveys the collection toner T1 having flowability lower than flowability of fresh toner. However, the toner conveyance device 130, 130X, or 130Z having the above-described structure can convey the collection toner T1, which has the lower flowability and therefore clogs the toner conveyance device 130, 130X, or 130Z easily, by suppressing clogging of the collection toner T1 and noise generating when the conveyance screw 131 conveys the collection toner T1.

As illustrated in FIG. 4A, the image forming station 3Y includes the lubricant applier 140Y for applying a lubricant to the surface of the photoconductor 10Y. Accordingly, even when the image forming station 3Y uses polymerization toner, a toner image formed on the photoconductor 10Y is transferred from the photoconductor 10Y onto the transfer belt 20 effectively. Further, the cleaner 13Y collects residual toner remaining on the surface of the photoconductor 10Y effectively.

When the lubricant is applied to the surface of the photoconductor 10Y, the collection toner T1 collected by the cleaner 13Y contains the lubricant. The collection toner T1 containing the lubricant provides flowability lower than flowability of collection toner not containing the lubricant. However, the toner conveyance device 130, 130X, or 130Z having the above-described structure can convey the collection toner T1 containing the lubricant, which has the lower flowability and therefore clogs the toner conveyance device 130, 130X, or 130Z easily, by suppressing clogging of the collection toner T1 and noise generating when the conveyance screw 131 conveys the collection toner T1.

As illustrated in FIG. 3, the cleaners 13Y, 13C, 13M, and 13K, each of which includes the toner conveyance device 130, 130X, or 130Z, and the photoconductors 10Y, 10C, 10M, and 10K are integrated into a unit, respectively, and supported in the image forming apparatus 100. For example, the cleaner 13Y and the photoconductor 10Y are integrated into a detachable unit (e.g., the image forming station 3Y) serving as a process cartridge detachably attached to the image forming apparatus 100. When the image forming station 3Y serving as an image forming device is formed into a detachable unit (e.g., a process cartridge), a user can set the image forming station 3Y into the image forming apparatus 100 easily and perform maintenance on the image forming station 3Y easily. Further, in the image forming station 3Y, the elements surrounding the photoconductor 10Y, such as the charger 11Y, the development device 12Y, the first transfer roller 24Y, the cleaner 13Y, and the lubricant applier 140Y depicted in FIG. 4A, can be positioned with respect to the photoconductor 10Y precisely.

Similarly, the cleaners 13C, 13M, and 13K and the photoconductors 10C, 10M, and 10K are integrated into process cartridges (e.g., detachable units), respectively.

In a toner conveyance device (e.g., the toner conveyance device 130, 130X, or 130Z depicted in FIG. 5A, 9, or 10A, respectively), a protrusion front edge surface (e.g., the protrusion front edge surface 162*t*, 162Wt, or 162Xt depicted in FIG. 6B, 8, or 9, respectively) of a first agitator (e.g., the agitator 16 depicted in FIG. 5A or 10A or the agitator 16X depicted in FIG. 9) contacts a helical outer circumferential surface (e.g., the helical outer circumferential surface 131*t* depicted in FIG. 6A) of a conveyance member (e.g., the conveyance screw 131 depicted in FIG. 6A).

A width (e.g., the width W1 depicted in FIG. 6B) of a basal portion (e.g., the basal portion 163 or 163W depicted in FIG. 6B or 8, respectively) of a protrusion (e.g., the protrusion 162, 162W, or 162X depicted in FIG. 6B, 8, or 9, respectively) in an axial direction of the conveyance member is greater than a helical pitch (e.g., the helical pitch Pw depicted in FIG. 6A) of a helical blade (e.g., the blade 131*b* depicted in FIG. 6A). Accordingly, at least a part of the protrusion front edge surface of the first agitator opposes the helical outer circumferential surface of the blade constantly.

A basal front edge surface (e.g., the basal front edge surface 163*t* depicted in FIG. 6B) of the basal portion serves as an upstream edge surface of the protrusion front edge surface of the protrusion in a toner conveyance direction (e.g., the toner conveyance direction C depicted in FIG. 6A) of the conveyance member. Accordingly, a contact position of the helical outer circumferential surface of the blade for contacting the protrusion front edge surface of the first agitator moves downstream in the toner conveyance direction in coordination with rotation of the conveyance member. When the contact position of the helical outer circumferential surface of the blade for contacting the protrusion front edge surface of the first agitator passes a convex front edge surface (e.g., the convex front edge surface 164*t* depicted in FIG. 6B) serving as a front edge surface of the protrusion front edge surface of the first agitator, the basal front edge surface serving as the upstream edge surface of the protrusion front edge surface of the first agitator contacts the helical outer circumferential surface of the blade.

The protrusion is shaped in such a manner that a distance from a body (e.g., the body 161 or 161X depicted in FIG. 5B or 9, respectively) to the protrusion front edge surface of the protrusion changes in the toner conveyance direction from the basal front edge surface of the basal portion to the convex front edge surface of a convex portion (e.g., the convex portion 164 or 164W depicted in FIG. 6B or 8, respectively). Accordingly, while the helical outer circumferential surface of the blade contacts the protrusion front edge surface of the first agitator, the contact position of the helical outer circumferential surface of the blade for contacting the protrusion front edge surface of the first agitator moves from the basal front edge surface of the basal portion to the convex front edge surface of the convex portion in such a manner that the helical outer circumferential surface of the blade slides over the protrusion front edge surface of the first agitator.

As described above, in coordination with rotation of the conveyance member, a contact portion of the protrusion front edge surface of the first agitator for contacting the helical outer circumferential surface of the blade of the conveyance member moves from the basal front edge surface to the convex front edge surface of the protrusion front edge surface of the protrusion. A distance from the body to the basal front edge surface of the protrusion is different from a distance from the body to the convex front edge surface of the protrusion. The movement of the contact portion of the protrusion front edge surface of the first agitator for contacting the helical outer circumferential surface of the blade of the conveyance member from the basal front edge surface to the convex front edge surface of the first agitator changes a distance between the body of the first agitator and a shaft (e.g., the shaft 131*a* depicted in FIG. 6A) of the conveyance member. Accordingly, the first agitator swings.

The first agitator swings while the protrusion front edge surface of the first agitator constantly opposes the helical outer circumferential surface of the blade of the conveyance member. In other words, in the first agitator, only the protrusion front edge surface of the first agitator contacts the helical outer circumferential surface of the blade. Further, the contact position of the helical outer circumferential surface of the blade for contacting the protrusion front edge surface of the first agitator moves from the basal front edge surface to the convex front edge surface of the protrusion front edge surface of the protrusion in such a manner that the helical outer circumferential surface of the blade slides over the protrusion front edge surface of the first agitator. Accordingly, when the helical blade contacts a convex upstream edge surface (e.g., the convex upstream edge surface 164*s* depicted in FIG. 6B) of the convex portion of the first agitator, the helical blade does not push the convex portion downward in the toner conveyance direction.

Consequently, when the first agitator swings and moves from a lower position at which the first agitator is disposed closer to the shaft of the conveyance member in such a manner that the helical outer circumferential surface of the blade contacts the basal front edge surface of the first agitator to an upper position at which the first agitator is disposed away from the shaft of the conveyance member in such a manner that the helical outer circumferential surface of the blade contacts the convex front edge surface of the first agitator, the blade does not hit and twang upstream edge surfaces of the first agitator, which are the body upstream edge surface 161*s* depicted in FIG. 5B and the basal upstream edge surface 163*s* depicted in FIG. 6B of the first agitator, suppressing noise generating in coordination with rotation of the conveyance member.

According to the above-described exemplary embodiments, a toner conveyance device (e.g., the toner conveyance device 130, 130X, or 130Z depicted in FIG. 5A, 9, or 10A, respectively) includes a conveyance path formation member (e.g., the casing 13*b*), a conveyance member (e.g., the conveyance screw 131), and a first agitator (e.g., the agitator 16 or 16X). The conveyance path formation member defines a conveyance path (e.g., the conveyance path 13P) through which to convey toner. The conveyance member is disposed within the conveyance path defined by the conveyance path formation member, and rotates and conveys the toner through the conveyance path in a toner conveyance direction corresponding to an axial direction of the conveyance member. The conveyance member includes a helical blade (e.g., the blade 131*b*) having a helical outer circumferential surface (e.g., the helical outer circumferential surface 131*t*). The first agitator includes a cantilevered, comb-toothed plate member of flexible material having a fixed end and a free end. The free end contacts the helical outer circumferential surface of the helical blade of the conveyance member and swings in coordination with rotation of the conveyance member to agitate the toner as the toner is conveyed through the conveyance path.

The first agitator further includes a body (e.g., the body 161 or 161X) and a protrusion (e.g., the protrusion 162, 162W, or 162X). The body bends in a bending direction substantially perpendicular to the axial direction of the conveyance member. The protrusion protrudes from the body in a protrusion direction opposite the bending direction of the body.

The protrusion includes a basal portion (e.g., the basal portion 163 or 163W), a convex portion (e.g., the convex portion 164 or 164W), and a protrusion front edge surface (e.g., the protrusion front edge surface 162*t*, 162Wt, or 162Xt). The basal portion is continuous with and adjacent and connected to the body. The basal portion has a first width greater than a helical pitch of the helical blade of the conveyance member in the axial direction of the conveyance member. The convex portion protrudes from the basal portion and has a second width smaller than the helical pitch of the helical blade of the conveyance member in the axial direction of the conveyance member. The protrusion front edge surface is provided on a front edge of the protrusion to contact the helical outer circumferential surface of the helical blade of the conveyance member. A distance between the protrusion front edge surface of the protrusion and the body changes within a predetermined range in the toner conveyance direction along the protrusion front edge surface of the protrusion.

The protrusion front edge surface of the protrusion includes a basal front edge surface (e.g., the basal front edge surface 163*t*) of the basal portion and a plurality of edge surfaces (e.g., the convex upstream edge surface 164*s*, the convex front edge surface 164*t*, and the convex downstream edge surface 164*e*) of the convex portion provided downstream from the basal front edge surface of the basal portion in the toner conveyance direction. The distance between the protrusion front edge surface of the protrusion and the body changes from the basal front edge surface of the basal portion to a convex front edge surface (e.g., the convex front edge surface 164*t*) of the plurality of edge surfaces of the convex portion.

The cantilevered plate member of the first agitator is bent near a front edge of the cantilevered plate member to divide the first agitator into the body and the protrusion including the front edge.

The conveyance member further includes a shaft (e.g., the shaft 131*a*) extending in the axial direction of the conveyance member. The helical blade is fixedly mounted on the shaft so that the conveyance member has a screw shape.

The first agitator swings in such a manner that the protrusion of the first agitator does not contact the shaft of the conveyance member.

A first length from a border between the basal portion and the convex portion of the protrusion of the first agitator in the protrusion direction in which the protrusion protrudes from the body of the first agitator to the convex front edge surface of the convex portion is smaller than a second length from the helical outer circumferential surface of the helical blade to a surface of the shaft of the conveyance member.

The protrusion of the first agitator protrudes toward the shaft of the conveyance member.

The toner conveyance device further includes a second agitator (e.g., the second agitator 17) to contact the first agitator and swing in coordination with swinging of the first agitator.

The second agitator includes a cantilevered, comb-toothed plate member of flexible material having a fixed end and a free end. The free end of the cantilevered plate member swings and agitates the toner in the conveyance path. A first swing width of the free end of the body of the first agitator is smaller than a second swing width of the free end of the second agitator.

A position of the fixed end of the cantilevered plate member of the first agitator substantially coincides with a position of the fixed end of the cantilevered plate member of the second agitator.

At least a part of the first agitator maintains constant contact with at least a part of the second agitator while the first agitator and the second agitator swing.

An image forming apparatus (e.g., the image forming apparatus 100 depicted in FIG. 3) includes an image carrier (e.g., the photoconductor 10Y, 10C, 10M, or 10K), a toner supplier (e.g., the toner bottle 7Y, 7C, 7M, or 7K), a development member (e.g., the development roller 15Y, 15C, 15M, or 15K), a transferor (e.g., the first transfer roller 24Y, 24C, 24M, or 24K), a cleaning member (e.g., the cleaning blade 13*a* depicted in FIG. 4A), a waste toner container (e.g., the waste toner container 151), a first toner conveyer (e.g., the first toner conveyer 121Y, 121C, 121M, or 121K), a second toner conveyer (e.g., the toner conveyance device 130, 130X, or 130Z), a third toner conveyer (e.g., the third toner conveyer 122Y depicted in FIG. 4A), a fourth toner conveyer (e.g., the fourth toner conveyer 150), and a toner conveyance device (e.g., the toner conveyance device 130, 130X, or 130Z).

The image carrier carries a latent image. The toner supplier contains toner. The development member supplies the toner supplied from the toner supplier to the latent image carried by the image carrier to form a toner image. The transferor transfers the toner image from the image carrier onto an intermediate transfer member (e.g., the transfer belt 20) or a recording medium. The cleaning member collects residual toner remaining on the image carrier after the toner image is transferred. The waste toner container receives and contains the toner sent from the cleaning member. The first toner conveyer conveys the toner supplied from the toner supplier to the development member. The second toner conveyer conveys the toner collected by the cleaning member inside a housing (e.g., the casing 13*b*) containing the cleaning member. The third toner conveyer conveys the toner sent from the cleaning member to the development member. The fourth toner conveyer conveys the toner sent from the cleaning member to the waste toner container. The toner conveyance device is provided in at least one of the first toner conveyer, the second toner conveyer, the third toner conveyer, and the fourth toner conveyer.

The image forming apparatus may use a polymerization toner.

The conveyance member conveys the toner collected by the cleaning member.

The image forming apparatus further includes a lubricant applier (e.g., the lubricant applier 140Y depicted in FIG. 4A) to apply a lubricant to a surface of the image carrier.

The toner conveyance device is detachably attached to the image forming apparatus.

The image forming apparatus further includes a charger (e.g., the charger 11Y, 11C, 11M, or 11K depicted in FIG. 3), a development device (e.g., the development device 12Y, 12C, 12M, or 12K), a cleaner (e.g., the cleaner 13, 13X, or 13Z depicted in FIG. 5A, 9, or 10Z, respectively), and a process cartridge (e.g., the image forming station 3Y, 3C, 3M, or 3K).

The charger charges the image carrier. The development device includes the development member to develop the latent image carried by the image carrier into the toner image. The cleaner includes the cleaning member to collect the residual toner remaining on the image carrier after the toner image is transferred. The process cartridge is detachably attached to the image forming apparatus as a detachable unit including the toner conveyance device, the image carrier, and at least one of the charger, the development device, and the cleaner.

With the above-described structures, the toner conveyance device and the image forming apparatus including the toner conveyance device can suppress noise generating in coordination with rotation of the conveyance member.

According to the above-described exemplary embodiments, a toner conveyance device (e.g., the toner conveyance device 130, 130X, or 130Z) serves as the second toner conveyer for conveying toner collected by the cleaning member inside the casing containing the cleaning member. Alternatively, the toner conveyance device may serve as a first toner conveyer (e.g., the first toner conveyer 121Y, 121C, 121Y, or 121K depicted in FIG. 3) for conveying fresh toner supplied from the toner supplier to the development member, a third toner conveyer (e.g., the third toner conveyer 122Y depicted in FIG. 4A) for conveying toner sent from the cleaning member to the development member, or a fourth toner conveyer (e.g., the fourth toner conveyer 150 depicted in FIG. 3) for conveying toner sent from the cleaning member to the waste toner container. Namely, the toner conveyance device may be provided in at least one of the first toner conveyer, the second toner conveyer, the third toner conveyer, and the fourth toner conveyer.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A toner conveyance device comprising:

a conveyance path formation member that defines a conveyance path through which to convey toner;

a conveyance member disposed within the conveyance path defined by the conveyance path formation member to rotate and convey the toner through the conveyance path in a toner conveyance direction corresponding to an axial direction of the conveyance member, the conveyance member comprising a helical blade having a helical outer circumferential surface; and a first agitator comprising a cantilevered, comb-toothed plate member of flexible material having a fixed end and a free end, the free end contacting the helical outer circumferential surface of the helical blade of the conveyance member and swinging in coordination with rotation of the conveyance member to agitate the toner as the toner is conveyed through the conveyance path, the first agitator further comprising:

a body that bends in a bending direction substantially perpendicular to the axial direction of the conveyance member; and a protrusion protruding from the body in a protrusion direction opposite the bending direction of the body, the protrusion comprising:

a basal portion continuous with and adjacent and connected to the body, the basal portion having a first width greater than a helical pitch of the helical blade of the conveyance member in the axial direction of the conveyance member;

a convex portion protruding from the basal portion and having a second width smaller than the helical pitch of the helical blade of the conveyance member in the axial direction of the conveyance member; and a protrusion front edge surface provided on a front edge of the protrusion to contact the helical outer circumferential surface of the helical blade of the conveyance member, a distance between the protrusion front edge surface of the protrusion and the body changing within a predetermined range in the toner conveyance direction along the protrusion front edge surface of the protrusion.

2. The toner conveyance device according to claim 1, wherein the protrusion front edge surface of the protrusion comprises a basal front edge surface of the basal portion and a plurality of edge surfaces of the convex portion provided downstream from the basal front edge surface of the basal portion in the toner conveyance direction, and wherein the distance between the protrusion front edge surface of the protrusion and the body changes from the basal front edge surface of the basal portion to a convex front edge surface of the plurality of edge surfaces of the convex portion.

3. The toner conveyance device according to claim 1, wherein the cantilevered plate member of the first agitator is bent near a front edge of the cantilevered plate member to divide the first agitator into the body and the protrusion including the front edge.

4. The toner conveyance device according to claim 1, wherein the conveyance member further comprises a shaft extending in the axial direction of the conveyance member, and the helical blade is fixedly mounted on the shaft so that the conveyance member has a screw shape, and wherein the first agitator swings in such a manner that the protrusion of the first agitator does not contact the shaft of the conveyance member.

5. The toner conveyance device according to claim 1, wherein the conveyance member further comprises a shaft extending in the axial direction of the conveyance member, and the helical blade is fixedly mounted on the shaft so that the conveyance member has a screw shape, and wherein a first length from a border between the basal portion and the convex portion of the protrusion of the first agitator in the protrusion direction in which the protrusion protrudes from the body of the first agitator to the convex front edge surface of the convex portion is smaller than a second length from the helical outer circumferential surface of the helical blade to a surface of the shaft of the conveyance member.

6. The toner conveyance device according to claim 4, wherein the protrusion of the first agitator protrudes toward the shaft of the conveyance member.

7. The toner conveyance device according to claim 1, further comprising a second agitator to contact the first agitator and swing in coordination with swinging of the first agitator.

8. The toner conveyance device according to claim 7, wherein the second agitator comprises a cantilevered, comb-toothed plate member of flexible material having a fixed end and a free end, the free end of the cantilevered plate member swings and agitates the toner in the conveyance path, and a first swing width of the free end of the body of the first agitator is smaller than a second swing width of the free end of the second agitator.

9. The toner conveyance device according to claim 8, wherein a position of the fixed end of the cantilevered plate member of the first agitator substantially coincides with a position of the fixed end of the cantilevered plate member of the second agitator.

10. The toner conveyance device according to claim 7, wherein at least a part of the first agitator maintains constant contact with at least a part of the second agitator while the first agitator and the second agitator swing.

11. An image forming apparatus comprising;

an image carrier to carry a latent image;

a toner supplier to contain toner;

a development member to supply the toner supplied from the toner supplier to the latent image carried by the image carrier to form a toner image;

a transferor to transfer the toner image from the image carrier onto an intermediate transfer member or a recording medium;

a cleaning member to collect residual toner remaining on the image carrier after the toner image is transferred;

a waste toner container to receive and contain the toner sent from the cleaning member;

a first toner conveyer to convey the toner supplied from the toner supplier to the development member;

a second toner conveyer to convey the toner collected by the cleaning member inside a housing containing the cleaning member;

a third toner conveyer to convey the toner sent from the cleaning member to the development member;

a fourth toner conveyer to convey the toner sent from the cleaning member to the waste toner container; and a toner conveyance device provided in at least one of the first toner conveyer, the second toner conveyer, the third toner conveyer, and the fourth toner conveyer, the toner conveyance device comprising:

a conveyance path formation member that defines a conveyance path through which to convey toner;

a conveyance member disposed within the conveyance path defined by the conveyance path formation member to rotate and convey the toner through the conveyance path in a toner conveyance direction corresponding to an axial direction of the conveyance member, the conveyance member comprising a helical blade having a helical outer circumferential surface; and a first agitator comprising a cantilevered, comb-toothed plate member of flexible material having a fixed end and a free end, the free end contacting the helical outer circumferential surface of the helical blade of the conveyance member and swinging in coordination with rotation of the conveyance member to agitate the toner as the toner is conveyed through the conveyance path, the first agitator further comprising:

a body that bends in a bending direction substantially perpendicular to the axial direction of the conveyance member; and a protrusion protruding from the body in a protrusion direction opposite the bending direction of the body, the protrusion comprising:

a basal portion continuous with and adjacent and connected to the body, the basal portion having a first width greater than a helical pitch of the helical blade of the conveyance member in the axial direction of the conveyance member;

a convex portion protruding from the basal portion and having a second width smaller than the helical pitch of the helical blade of the conveyance member in the axial direction of the conveyance member; and a protrusion front edge surface provided on a front edge of the protrusion to contact the helical outer circumferential surface of the helical blade of the conveyance member, a distance between the protrusion front edge surface of the protrusion and the body changing within a predetermined range in the toner conveyance direction along the protrusion front edge surface of the protrusion.

12. The image forming apparatus according to claim 11, wherein the protrusion front edge surface of the protrusion comprises a basal front edge surface of the basal portion and a plurality of edge surfaces of the convex portion provided downstream from the basal front edge surface of the basal portion in the toner conveyance direction, and wherein the distance between the protrusion front edge surface of the protrusion and the body changes from the basal front edge surface of the basal portion to a convex front edge surface of the plurality of edge surfaces of the convex portion.

13. The image forming apparatus according to claim 11, wherein the toner includes a polymerization toner.

14. The image forming apparatus according to claim 11, wherein the conveyance member conveys the toner collected by the cleaning member.

15. The image forming apparatus according to claim 14, further comprising a lubricant applier to apply a lubricant to a surface of the image carrier.

16. The image forming apparatus according to claim 11, wherein the toner conveyance device is detachably attached to the image forming apparatus.

17. The image forming apparatus according to claim 16, further comprising:

a charger to charge the image carrier;

a development device including the development member to develop the latent image carried by the image carrier into the toner image;

a cleaner including the cleaning member to collect the residual toner remaining on the image carrier after the toner image is transferred; and a process cartridge detachably attached to the image forming apparatus as a detachable unit including the toner conveyance device, the image carrier, and at least one of the charger, the development device, and the cleaner.

* * * * *